US005187313A

United States Patent [19]

Inoue

[11] Patent Number: 5,187,313

[45] Date of Patent: Feb. 16, 1993

[54] MUSICAL TONE SYNTHESIZING APPARATUS

[75] Inventor: Toshihiro Inoue, Hamamatsu, Japan

[73] Assignee: Yamaha Corporation, Hamamatsu, Japan

[21] Appl. No.: 562,102

[22] Filed: Aug. 2, 1990

[30] Foreign Application Priority Data

| | | | |
|---|---|---|---|
| Aug. 4, 1989 | [JP] | Japan | 1-202628 |
| Aug. 4, 1989 | [JP] | Japan | 1-202629 |
| Aug. 4, 1989 | [JP] | Japan | 1-202630 |
| Aug. 4, 1989 | [JP] | Japan | 1-202631 |
| Aug. 4, 1989 | [JP] | Japan | 1-202632 |
| Aug. 4, 1989 | [JP] | Japan | 1-202633 |

[51] Int. Cl.[5] ..... G10H 1/02; G10H 1/06; G10H 1/16; G10H 5/00

[52] U.S. Cl. ..... 84/622; 84/625; 84/659; 84/660; 84/661; 84/DIG. 9; 84/DIG. 26

[58] Field of Search ..... 84/622, 624, 625, 659, 84/660, 661, DIG. 26, DIG. 9

[56] References Cited

U.S. PATENT DOCUMENTS

| | | | |
|---|---|---|---|
| 4,463,650 | 8/1984 | Rupert | 84/622 X |
| 4,864,625 | 9/1989 | Hanzawa et al. | 84/603 X |
| 4,984,276 | 1/1991 | Smith | 84/630 X |

FOREIGN PATENT DOCUMENTS 63-40199 2/1988 Japan .

*Primary Examiner*—William M. Shoop, Jr.

*Assistant Examiner*—Brian Sircus

*Attorney, Agent, or Firm*—Graham & James

[57] ABSTRACT

A musical tone synthesizing apparatus simulating a wind instrument includes an excitation circuit simulating a reed operation of a mouth piece portion, a resonance circuit simulating a resonance tube and a musical tone control circuit. The excitation circuit produces an excitation signal based on an input signal and a reflected wave signal transmitted from the resonance circuit. The excitation signal is input to the resonance circuit. The resonance circuit includes a bi-directional transmission circuit and a junction unit which is inserted into the bi-directional transmission circuit. The junction unit caries out a scattering operation corresponding to a scattering operation of compression wave of air which is occurred in the vicinity of the tone hole of the resonance tube. The excitation signal propagates through the bi-directional transmission circuit in a forward direction as a progressive wave signal. Then, a signal which is occurred by a scattering operation of the junction unit and the like propagates through the bi-directional transmission circuit in a backward direction as foregoing reflected wave signal. The signal operation of the resonance circuit, i.e., the delay time required for circulating the excitation signal through the closed-loop including the excitation circuit at least is controlled by the musical tone control circuit in response to an open/-close operation applied to a tone hole so that musical tones which are generated by the non-electronic wind instrument having a plurality of tone holes are to be synthesized.

11 Claims, 14 Drawing Sheets rtc=-1,-0.9,-0.8 rtc=1 rtc=1 rtc=-1 rtc=1 rtc=-1

MUSICAL TONE SYNTHESIZING APPARATUS

BACKGROUND OF THE INVENTION

1. Field of the Invention

The present invention relates to a musical tone synthesizing apparatus which simulates the non-electronic wind instruments and the like.

2. Prior Art

Conventionally, Japanese Patent Laid-Open Publication No. 63-40199 discloses an apparatus capable of synthesizing the sound of a non-electronic musical instrument by use of a simulation model which simulates the tone-generation mechanism of the non-electronic musical instrument.

In case of the wind instrument, when the resonance state is established between the non-linear vibration of a reed which is produced by the breath pressure applied thereto and the vibration of the compression wave of air which is produced in the resonance tube by non-linear vibration of the reed, the musical tone is produced from the wind instrument.

The most basic simulation model of a wind instrument such as clarinet includes a non-linear amplifier simulating the reed operation and a bi-directional transmission circuit simulating the resonance tube in which the compression wave of air propagates.

In this model, the output signal of the non-linear amplifier propagates through the bi-directional transmission circuit and is reflected at its terminal portion corresponding to the terminal portion of the resonance tube. Then, the reflected signal propagates through bi-directional transmission circuit and is fed back to the non-linear amplifier. In this manner, the simulation model of the tone-generation mechanism of the non-electronic wind instrument is embodied by the signal operation carried out by a closed-looped circuit including the non-linear amplifier and the bi-directional transmission circuit.

Additionally, the simulation model of the wind instrument which has plural tone holes for controlling a tone pitch is known. In this model, the simulation circuit for the wind instrument's tube includes plural bi-directional transmission circuits each simulating the path in which the compression wave of air propagates, junction units each simulating the scattering of compression waves at each point of the tube where each tone hole is made and a terminal circuit simulating the terminal portion of the tube. More specifically, the bi-directional transmission circuits and the junction units are connected together in the cascade-interconnection manner. In addition, the delay time of the first bi-directional transmission circuit corresponds to the path of compression wave between the reed and the first tone hole; the second bi-directional transmission circuit corresponds to the path of the compression wave between the first tone hole and the second tone hole; . . . the last bi-directional transmission circuit corresponds to the path of the compression wave between the last tone hole and the terminal portion of the tube. The last bi-directional transmission circuit is terminated by the terminal circuit including a low-pass filter simulating the acoustic loss of the terminal portion of the tube and an invertor simulating phase inverting phenomenon which is caused when reflecting the compression wave of air.

In each junction unit, the predetermined operation including coefficiency multiplication and the like is carried out on the signal output from a neighboring bi-directional transmission circuit, and the result of the operation is sent to a neighboring bi-directional transmission circuit. Each coefficient used for multiplication carried out by junction units are predetermined based on the shape of the tube and tone hole. In addition, each coefficient of the above mentioned operation is controlled in response to the finger operation applied to each tone hole.

The reflected signal from each junction unit or the terminal circuit is fed back to the non-linear amplifier. Thus, the signal is repeatedly circulating through the loop including the non-linear amplifier, junction unit and the terminal circuit. Since, each of the coefficients used in the junction units is controlled in response to the open/close state of each tone hole, resulting that the transmission frequency characteristic is varied in response to open/close state of each tone hole. More specifically, the primary resonance frequency is determined by the total delay time including the first delay time and the second delay time. In the case where at least one tone hole is opened, the first delay time is produced by the output signal of the non-linear amplifier to be propagated to the junction unit corresponding to first opened tone hole, while the second delay time is produced by the reflected signal of the junction unit to be fed back to the non-linear amplifier. Herein, the first opened tone hole designates the tone hole which is opened and is most nearly positioned by the reed. On the other hand, in the case where all of the tone holes are closed, the first delay time is produced by the output signal of the non-linear amplifier to be propagated to the terminal circuit, while the second delay time is produced by the reflected signal of the terminal circuit to be fed back to the non-linear amplifier. The transmission frequency characteristic has a plurality of peak portions each corresponding to each of the several resonance frequencies including the primary resonance frequency and its higher harmonic frequency to be produced when performing the non-electronic instrument. In addition, one of the paths through which the signal is circulating is selected by controlling each coefficient used in each junction unit, resulting that the transmission frequency characteristic of the resonance circuit is controlled. Thus, the pitch of the synthesized musical tone is controlled.

However, the conventional musical tone synthesizing apparatus needs a plurality of the junction units when synthesizing the musical tones produced by the non-electronic wind instrument having a plurality of tone holes. Thus, there is a problem in that the large-scale hardware is necessary in order that the musical tone synthesizing apparatus can synthesize such musical tones. In addition, when synthesizing the musical tone by use of the software operation, there is a problem in that a long operating time is needed for synthesizing the musical tone and consequently the musical tone cannot be obtained at real-time basis. On the other hand, in the performance of the non-electronic wind instrument, the tone pitch can be changed over between the basic tone pitch corresponding to the substantial tube length and another higher harmonic tone without changing the open/close state of tone hole. However, the musical tone synthesizing apparatus cannot control the generation of musical tones including the basic tone and its another higher harmonic tones such as to be produced by non-electronic wind instrument.

SUMMARY OF THE INVENTION

It is accordingly a primary object of present invention to provide a musical tone synthesizing apparatus capable of synthesizing musical tones which are produced by non-electronic wind instruments having plural tone holes without using the large-scale hardware or requiring a long generation time.

In addition, it is accordingly a secondary object of present invention to provide a musical tone synthesizing apparatus capable of controlling the generation of musical tones including the basic tone and its another higher harmonic tones such as to be produced by non-electronic wind instruments.

In an aspect of the present invention, there is provided a musical tone synthesizing apparatus comprising:

excitation means for producing an excitation signal based on an input signal and a reflected wave signal;

resonance means including (a) bi-directional transmission means having a delay time for propagating said excitation signal in a forward direction as a progressive wave signal and also propagating signal reflected at each portion thereof in a backward direction as said reflected wave signal, and (b) junction units means inserted into said bi-directional transmission means for carrying out a scattering operation of said progressive wave signal and said reflected wave signal; and control means for controlling a signal operation of said resonance means in response to an open/close operation applied to a tone hole provided on wind instrument to be simulated, wherein a synthesized musical tone signal is output from any node of said resonance means and/or said excitation means.

BRIEF DESCRIPTION OF THE DRAWING

Further objects and advantages of the present invention will be apparent from the following description, reference being had to the accompanying drawings wherein preferred embodiments of the present invention are clearly shown.

In drawings.

DESCRIPTION OF PREFERRED EMBODIMENTS

Hereinafter, description will be given with respect to preferred embodiments of the musical tone synthesizing apparatus according to the present invention.

[A] FIRST EMBODIMENT

Figure 1:
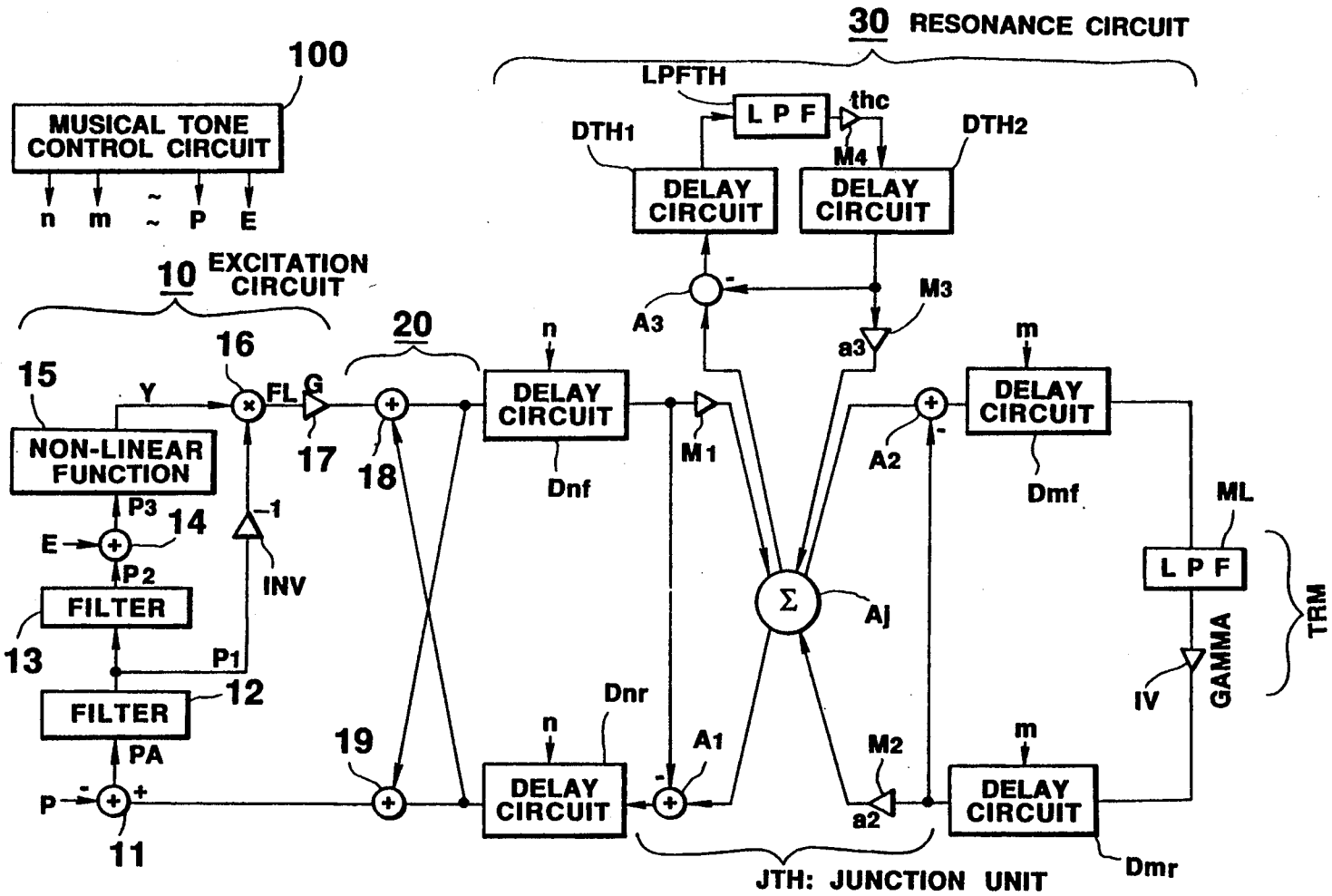
FIG. 1 is a block diagram showing the musical tone synthesizing apparatus according to a first embodiment of the present invention.

FIG. 1 is a block diagram showing the electric configuration of the musical tone synthesizing apparatus according to the first embodiment of the present invention.

Figure 2:
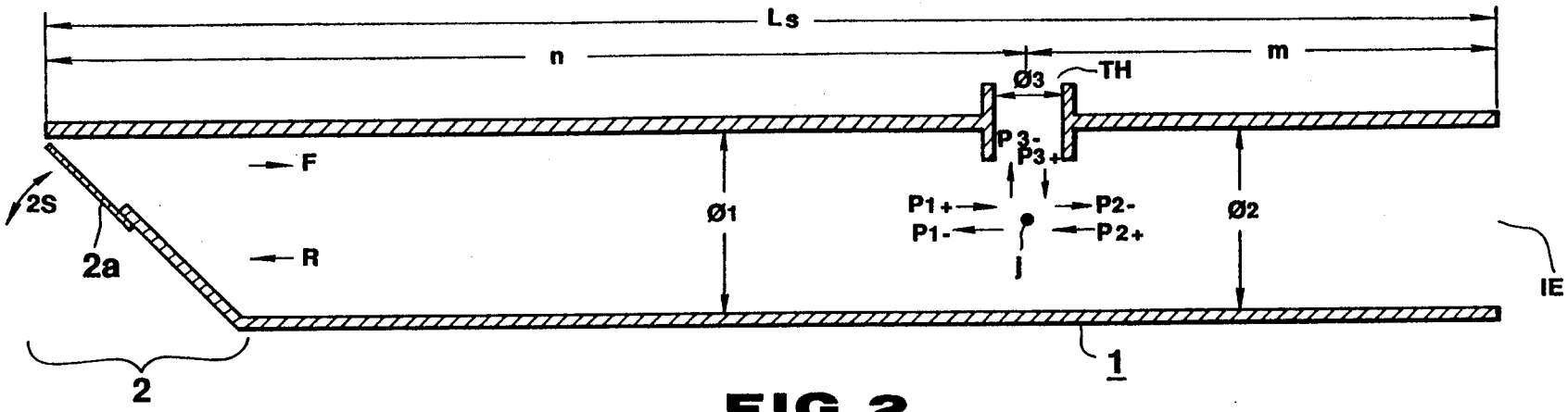
FIG. 2 shows a configuration of a physical model of the wind instrument corresponding to the first embodiment of the present invention.

FIG. 2 shows a configuration of the physical model of a wind instrument such as a clarinet and the like, wherein the physical model corresponds to the musical tone synthesizing apparatus shown in FIG. 1.

As shown in FIG. 2, the physical model corresponding to the first embodiment includes a resonance tube 1, a mouth piece portion 2, a reed 2*a* and a tone hole TH formed through the resonance tube 1.

Hereinafter, referring to FIG. 2, the description will be given with respect to the operation carried out by the physical model corresponding to this embodiment. When the mouth piece portion 2 is held in a performer's mouth and the performer blows his breath into the inside of the mouth piece portion 2 with blowing pressure P, the reed 2*a* vibrates in direction 2S due to blowing pressure P and its elastic characteristics. As a result, pressure wave (i.e., compression wave) of air is produced in the vicinity of the reed 2*a* within the tube 1. Then, such compression wave progresses toward a terminal portion 1E of the tube 1 as progressive compression wave F. This progressive compression wave F is reflected at each portion in the tube 1 including terminal portion 1E and the other, and then, the reflected compression wave R is fed back to the reed 2*a*, resulting that the reed 2*a* is affected by pressure PR due to reflected compression wave R. Therefore, while blowing the wind instrument, the reed 2*a* is affected by the following pressure PA.

$$PA = P - PR \tag{1}$$

And then, the reed 2*a* is vibrated by pressure PA and elastic characteristic thereof. The resonance state is established between the vibration of the reed 2*a* and the reciprocating operation of the compression waves F, R, so that the musical tone is generated in this physical model.

In this case, the resonance frequency is changed over by open/close operation applied to the tone hole TH. More specifically, when the open/close operation is applied to the tone hole TH by the performer's finger, the scattering phenomenon of the compression wave is varied in the vicinity of the tone hole TH, so that substantial length of the tube is varied, whereby the resonance frequency is to be changed over.

Hereinafter, description of the the scattering phenomenon of the compression wave in the vicinity of the tone hole TH is given.

The case where the tone hole TH is opened.

The following formula (2) represents air pressure Pj at the point j in the vicinity of the tone hole TH of the resonance tube 1 shown in FIG. 2.

$$Pj = a_{1off}P_{1+} + a_{2off}P_{2+} + a_{3off}P_{3+} \tag{2}$$

Herein, $P_{1+}$ designates the pressure of the compression wave which enters into the point j from the reed 2*a*; $P_{2+}$ designates the pressure of the compression wave which enters into the point j from the terminal portion 1E; and $P_{3+}$ designates the pressure of the compression wave which enters into the point j from tone hole TH. In addition, $a_{1off}$, $a_{2off}$, $a_{3off}$ designate ratios which determine the relation between the pressure Pj and each pressure $P_{1+}$, $P_{2+}$ and $P_{3+}$, and can be represented by the following formulae (3), (4) and (5).

$$a_{1off}=2\phi_1^2/(\phi_1^2+\phi_2^2+\phi_3^2) \quad (3)$$

$$a_{2off}=2\phi_2^2/(\phi_1^2+\phi_2^2+\phi_3^2) \quad (4)$$

$$a_{3off}=2\phi_3^2/(\phi_1^2+\phi_2^2+\phi_3^2) \quad (5)$$

In above the formulae, $\phi_1$ designates the diameter of the tube 1 in reed side; $\phi_2$ designates the diameter of the tube 1 in terminal side; and $\phi_3$ designates the diameter of tone hole TH. Meanwhile, the following formulae (6), (7) and (8) represent pressure $P_{1-}$ of the compression wave which flows from the point j toward the reed 2*a*; pressure $P_{2-}$ of the compression wave which flows from the point j toward the terminal portion 1E; and pressure $P_{3-}$ of the compression wave which flows from the point j toward tone hole TH.

$$P_{1-}=Pj-P_{1+} \quad (6)$$

$$P_{2-}=Pj-P_{2+} \quad (7)$$

$$P_{3-}=Pj-P_{3+} \quad (8)$$

In FIG. 2, the compression wave propagates from the point j through the tube 1 and reaches at the terminal portion 1E. Then, a part of reached compression wave is reflected and propagates toward the reed 2*a* thereof. Herein, in the case where the terminal portion 1E is opened as the clarinet, when the reflection is occurred at the terminal portion 1E, the phase of the reflected compression wave is inverted from the phase of compression wave entered thereto. In addition, in the case where the tone hole TH is opened, when the reflection occurs at the tone hole TH, the phase of the reflected compression wave is inverted from the phase of compression wave entered thereto.

The case where tone hole TH is closed

This case can be considered as equivalent to the case where the diameter $\phi_3$ of the tone hole TH is at "0". Thus, coefficients $a_{1on}$, $a_{2on}$ and $a_{3on}$ which designate ratios determining the relation between the pressure Pj and each pressure $P_{1+}$, $P_{2+}$ and $P_{3+}$ can be represented by the following formulae (9), (10) and (11) respectively.

$$a_{1on}=2\phi_1^2/(\phi_1^2+\phi_2^2) \quad (9)$$

$$a_{2on}=2\phi_2^2/(\phi_1^2+\phi_2^2) \quad (10)$$

$$a_{3on}=0 \quad (11)$$

In this case, Pj which designates the pressure of point j is represented by the following formula (12).

$$Pj=a_{1on}P_{1+}+a_{2on}P_{2+}+a_{3on}P_{3+} \quad (12)$$

Hereinafter, description will be given with respect to the musical tone synthesizing apparatus shown in FIG. 1 which designed based on the physical model of the wind instrument shown in FIG. 2.

In FIG. 1, an excitation circuit 10 corresponds to mouth piece portion 2 shown in FIG. 2, and a resonance circuit 30 corresponds to resonance tube 1 shown in FIG. 2. A junction unit 20 is provided between the excitation circuit 10 and the resonance circuit 30. Herein, the junction unit 20 includes adders 18 and 19. The junction unit 20 simulates the scattering phenomenon at the connection between the mouth piece portion 2 and the resonance tube 1. In the junction unit 20, the output signal of the resonance circuit 30 and the output signal of the excitation circuit 10 are summed by the adder 18. The output signal of the adder 18 is supplied to the resonance circuit 30. In addition, the output signal of the adder 18 and the output signal of the resonance circuit 30 is summed by the adder 19. The output signal of the adder 19 is supplied to the excitation circuit 10.

The excitation circuit 10 includes a subtractor 11, filters 12 and 13, multipliers 16, 17 and INV. Pressure data P designating the blowing pressure and embouchure data E designating the pressure affected to the reed 2*a* when holding the mouth piece with the performer's tooth are supplied to the excitation circuit 10 by a tone controlling circuit 100. The pressure data PR of the reflected compression wave R transmitted from the resonance circuit 30 via junction unit 20, and the pressure information P of the blowing pressure are supplied to the subtractor 11. Then, the operation corresponding to the formula (1) is carried out by the subtractor 11, resulting that the signal corresponding to the air pressure affected to the reed 2*a* is output from the subtractor 11.

The output signal of the subtractor 11 is attenuated by the filter 12 in accordance with transmission frequency characteristics thereof. Herein, the filter 12 can be made of the first-order digital low-pass filter. The low-pass filter 12 is provided in order to prevent the error operation in which the amplitude of the signal circulating the closed-loop including the excitation circuit 10 and the resonance circuit 30 exceeds the normal amplitude range at the specified frequency. The output signal $P_1$ of the filter 12 is supplied to filter 13. On the other hand, the signal $P_1$ is inverted in phase by the multiplier INV using multiplication coefficient "−1". Then, the phase inverted signal $-P_1$ transmitted from the multiplier INV is supplied to the multiplier 16. The signal $P_1$ is reject its high frequency components by passing through the filter 13 so that the insensitive response of the reed 2*a* when applying the sudden variation of the pressure thereto is simulated.

The output signal $P_2$ of the filter 13 and the embouchure data E are supplied to the adder 14, thus, the signal $P_3$ corresponding to the pressure actually affected to the reed 2*a* is operated by the adder 14. Then, the output signal $P_3$ of the adder 14 is supplied as read-out address to ROM 15. Herein, non-linear function table prescribing the relation between the pressure affected to the reed 2*a* and the cross section square measurement of the slit enclosed by the mouth piece portion 2 and the reed 2*a* is stored in the ROM 15. Then, the signal Y designating the cross section square measurement of slit enclosed by mouth piece portion 2 and the reed 2*a*, i.e., the admittance of the air flow of the slit is output from the area of ROM 15 addressed by the signal $P_3$. In the multiplier 16, the signal Y is multiplied by the signal $-P_1$. As a result, the signal FL designating the velocity of air which flows through the slit between the reed 2*a* and the mouth piece portion 2 is output from the multiplier 16.

In the multiplier 17, the signal FL is multiplied by multiplication coefficient G designating the difficulty of the air flowing into resonance tube 1 from mouth piece portion 2, i.e., impedance of air flow, and which is predetermined according to the diameter of resonance tube 1 in the vicinity of mouth piece portion 2. Thus, from the multiplier 17, the output signal which corresponds to the variation of the air pressure occurring at the entrance side of mouth piece portion in the resonance tube 1 is obtained. And then, the output signal of the multiplier 17 is supplied to the resonance circuit 30 via the junction unit 20.

In the resonance circuit 30, there are provided delay circuits Dnf, Dmf, Dmr, Dnr respectively corresponding to the path through which the compression wave of air propagates in the resonance tube 1 as shown in FIG. 2. More specifically, the propagation delay time of the delay circuit Dnf is determined according to the time to be required when the progressive compression wave F propagating from the reed 2a to the tone hole TH; the propagation delay time of the delay circuit Dmf is determined according to the time to be required when the progressive compression wave F propagating from the tone hole TH to the terminal portion 1E; the propagation delay time of the delay circuit Dmr is determined according to the time to be required when the reflected compression wave R propagating from the terminal portion 1E to the tone hole TH; and the propagation delay time of the delay circuit Dnr is determined according to the time to be required when the reflected compression wave R propagating from the tone hole TH to the reed 2a.

A terminal circuit TRM is provided at the terminal portion of the resonance circuit 30. The terminal circuit includes a low-pass filter ML and a multiplier IV. The low-pass filter ML simulates the acoustic loss of the terminal portion 1E. The progressive wave signal propagating through the resonance circuit 30 in a forward direction and output from the delay circuit Dmf is passed through the low-pass filter ML. As a result the progressive wave signal is attenuated in accordance with the transmission frequency characteristic of the low-pass filter ML. In the multiplier IV, the output signal of low-pass filter ML is multiplied by the minus attenuation coefficient GAMMA. Then, the result of the multiplication is supplied to the delay circuit Dmr as the signal corresponding to the reflected compression wave transmitted from the terminal portion 1E.

The junction unit JTH simulates the scattering of the compression wave of air at the vicinity of the tone hole TH in the resonance tube shown in FIG. 2. The junction unit JTH comprises an adder Aj, multipliers $M_1$, $M_2$, $M_3$, $M_4$, subtractors $A_1$, $A_2$, $A_3$, delay circuits $DTH_1$, $DTH_2$, and an low-pass filter LPFTH. In the multiplier $M_1$, the output signal of the delay circuit Dnf corresponding to the pressure $P_{1+}$ of the progressive compression wave which propagates into the point j from the reed 2a shown in FIG. 2 is multiplied by coefficient $a_1$. In the multiplier $M_2$, the output signal of the delay circuit Dmr corresponding to the pressure $P_{2+}$ of reflected compression wave which propagates into the point j from the terminal portion 1E is multiplied by coefficient $a_2$. In the multiplier $M_3$, the output signal of the delay circuit $DTH_2$ corresponding to the pressure $P_{3+}$ of the reflected compression wave which propagates into the point j from the terminal portion 1E is multiplied by coefficient $a_3$. Herein, in the case where the tone hole TH is opened, above-mentioned coefficients $a_{1off}$, $a_{2off}$, $a_{3off}$ which are represented by the foregoing formulae (3) to (5) are supplied to the multipliers $M_1$, $M_2$, $M_3$ as the coefficients $a_1$, $a_2$, $a_3$. In the case where the tone hole TH is closed, above mentioned coefficients $a_{1on}$, $a_{2on}$, $a_{3on}$ which are represented by the formulae (9) to (11) are respectively supplied to the multipliers $M_1$, $M_2$, $M_3$. The multiplication results of the multipliers $M_1$, $M_2$, $M_3$ are summed by the adder Aj.

The summation result of the adder Aj which corresponds to the pressure of the air at the point j is supplied to the subtractors $A_1$, $A_2$ and $A_3$. The subtractor $A_1$ subtracts the output signal of the circuit Dnf corresponding to the pressure $P_{1+}$ from the output signal of the adder Aj corresponding to the air pressure Pj at the point j, and then the subtraction result corresponding to the pressure $P_{1-}$ is sent to the delay circuit Dnr as the signal corresponding to the compression wave propagating from the point j toward the reed 2a. The subtractor $A_2$ subtracts the output signal of the delay circuit Dmr corresponding to the pressure $P_{2+}$ from the output signal from the adder Aj, and then the subtraction result corresponding to the pressure $P_{2-}$ is sent to the delay circuit Dmr as the signal corresponding to the compression wave propagating from the point j toward the terminal portion 1E. The output signal of the delay circuit $DTH_2$ designating the pressure $P_{3+}$ and the output signal of the adder Aj designating the pressure Pj are supplied to the subtractor $A_3$. Then, the subtracting operation $P_{3-}=Pj-P_{3+}$ is carried out by the subtractor $A_3$. The subtraction result of the subtractor $A_3$ is sent to the delay circuit $DTH_1$ as the signal designating the compression wave propagating from the point j toward the terminal portion of the tone hole TH.

The output signal from the subtractor $A_3$ is delayed for the predetermined time by passing through the delay circuit $DTH_1$. The delayed signal transmitted from the delay circuit $DTH_1$ is input to the low-pass filter LPFTH simulating the acoustic loss characteristics of the tone hole TH, so that the input signal is attenuated in accordance with the transmission frequency characteristics thereof. In the multiplier $M_4$, the output signal of the low-pass filter LPFTH is multiplied by the reflection coefficient thc. Herein, the reflection coefficient thc is controlled by the musical tone control circuit 100 according to the open/close operation applied to the tone hole TH. The multiplication result of the multiplier $M_4$ is delayed by passing through the delay circuit $DTH_2$, and the delayed signal is supplied to the subtractor $A_3$ and the multiplier $M_3$. Herein, the same delay time of the delay circuits $DTH_1$ and $DTH_2$ is respectively determined according to the cylindrical height of the tone hole TH, i.e., the delay time required for which the compression wave propagates in a direction through the tube-like portion of the tone hole TH toward the outside of the tube 1 or the opposite direction. In this manner, the propagation of the compression wave at the point j in the vicinity of the tone hole TH can be simulated.

As an example, in the case of the clarinet to be actually performed, there are provided a plurality of the tone holes corresponding to a plurality of tone pitches. However, it is necessary to provide the large-scale hardware when realizing the musical tone synthesizing apparatus which provides the junction units JTH corresponding to all of tone holes provided in the clarinet. In the case where the musical tone synthesizing apparatus is realized by using the software processing, quantity of operation is increased, and consequently the operational time is increased. As a result, it is difficult to synthesize the musical tone at real time basis. The musical tone synthesizing apparatus according to the first embodiment of the present invention can generate a plurality of synthesized musical tones having various pitches without providing a plurality of the junction units JTH as follows.

The delay circuits Dnf, Dnr, Dmf, Dmr shown in FIG. 1 are programmable delay circuits which can be programmed to change the propagation delay time. The delay times of the delay circuits Dnf, Dnr, Dmf, Dmr are programmed according to the pitch of the musical tone to be synthesized. Herein, the programmable delay circuit can be made up of a shift register and a selector. The signal to be delayed is input to the shift register, and then the input signal is shifted through the stages of the shift register each time when the shift clock (sampling clock) is supplied to the shift register. One of the output signals which are output from the stages of the shift register is selected by the selector in accordance with the delay time designation data. And then, the selected signal is output as the delayed signal corresponding to the delay time designation data.

Hereinafter, detailed description will be given with respect to the manner how to assign the delay times to the delay circuits Dnf, Dnr, Dmf, Dmr. Now, the tone hole TH indicates the tone hole which is opened but is at the nearest position of the reed 2a. Hereinafter, such tone hole will be called as "first opened tone hole". In this case, the delay circuit Dnf, Dnr are both supplied with the same delay time designation data n corresponding the length between the reed 2a and the tone hole TH by the musical control circuit 100. In the case where the delay circuits Dnf, Dnr are made up of the shift register and the selector as above mentioned, number of the delay stages of the delay circuit Dnf, Dnr is determined according to the designation data n. In addition, if the delay time designation data corresponding to the total length of the resonance tube 1 is Ls, the delay circuit Dmf, Dmr will be both supplied with the same delay time designation data $m=Ls-n$ corresponding to the length between the tone hole TH and the terminal portion 1E by the musical control circuit 100. The junction unit JTH is supplied with the coefficients $a_{1off}$, $a_{2off}$, $a_{3off}$ and the minus reflection coefficient thc. On the other hand, in the case where all of the tone holes are closed by the performer's fingers, the delay time designation data n and m are determined according to the tone hole which is at the nearest position of the terminal portion 1E. In addition, the junction unit JTH is supplied with the coefficients $a_{1on}$, $a_{2on}$, $a_{3on}$ and the plus reflection coefficient thc.

In the clarinet to be actually performed, the diameter of the tube 1 ($\phi_1$ and $\phi_2$) may be not constant, or the respective diameter of all the tone holes may not be equally made. In this embodiment, the coefficients $a_{1off}$, $a_{2off}$, $a_{3off}$ have been previously operated according to the above mentioned formulae (3) to (5) by using the diameter $\phi_3$ of the tone hole and the diameters $\phi_1$, $\phi_2$ of the portion of the tube 1 in the vicinity of the tone hole with respect to all of the tone holes provided to the clarinet.

In addition, with respect to the tone hole which is formed at the nearest position of the terminal portion 1E, the coefficients $a_{1on}$, $a_{2on}$, $a_{3on}$ have been previously operated according to the above mentioned formulae (9) to (11) by using the foregoing diameters $\phi_1$, $\phi_2$, $\phi_3$ of such tone hole.

The table of the coefficients $a_{1off}$, $a_{2off}$, $a_{3off}$ and $a_{1on}$, $a_{2on}$, $a_{3on}$ previously operated as above mentioned manner is stored in the storage means (not shown), for example ROM. When synthesizing the musical tone, the coefficients $a_{1off}$, $a_{2off}$, $a_{3off}$ or $a_{1on}$, $a_{2on}$, $a_{3on}$ are generated based on the open/close operation applied to the tone holes. More specifically, in the case where at least one tone hole is opened, the coefficients $a_{1off}$, $a_{2off}$, $a_{3off}$ corresponding to the first opened tone hole are read-out from the ROM. The read-out coefficients of the ROM are supplied to the junction unit JTH as the coefficients $a_1$, $a_2$, $a_3$. In the case where all tone holes are closed, the coefficients $a_{1on}$, $a_{2on}$, $a_{3on}$ are read-out from the ROM and supplied to the junction unit JTH as the coefficients $a_1$, $a_2$, $a_3$.

In this manner, the delay times of the delay circuits Dnf, Dnr, Dmf, Dmr and the coefficients $a_1$, $a_2$, $a_3$, thc used for the junction unit JTH are controlled in response to the open/close operation applied to the tone holes so that the musical tones which are generated by the wind instrument having a plurality of tone holes are to be synthesized. If the diameter of all tone holes are constant and the diameter of the tube are constant, the same coefficients $a_{1off}$, $a_{2off}$, $a_{3off}$, $a_{1on}$, $a_{2on}$, $a_{3on}$ can be commonly used for the open/close operations applied to the tone holes.

Hereinafter, description will be given with respect to the operation of this embodiment. Now, when a manually operable member, for example, keyboard is turned on, the tone hole position corresponding to the tone pitch of the turned on key, i.e., the first opened tone hole is operated by the musical tone control circuit 100. Then, the delay time designation data n and m corresponding to the pitch of the musical tone corresponding to the first opened tone hole are produced by the musical tone control circuit 100. The same delay time designation data n is supplied to both of the delay circuits Dnf, Dnr. The same delay time designation data m is supplied to both of the delay circuits Dmf, Dmr. In addition, the multiplication coefficients $a_1$, $a_2$, $a_3$ and the reflection coefficient corresponding to the open/close state of the tone hole are supplied to the junction unit JTH.

The blowing pressure data P and the embouchure data E are supplied to the excitation circuit 100. Then, the excitation signal is generated based on the blowing pressure data P and the embouchure data E by the excitation circuit 10. The excitation signal is supplied to the resonance circuit 30 via the junction unit 20. The excitation signal propagates through the resonance circuit 30 as progressive wave signal. The progressive wave signal is reflected and attenuated at each portion of the resonance circuit 30. Then, the reflected signal transmitted from each portion of the resonance circuit 30 is fed back to the excitation circuit 10 via the junction unit 20. In the excitation circuit 10, the excitation signal is newly generated based on the pressure data P, the embouchure data E and the fed back signal transmitted from the resonance circuit 30. The excitation signal is supplied to the resonance circuit 30 via the junction unit 20 again. Thereafter, the excitation signal is repeatedly circulated in a loop including the excitation circuit 10 and the resonance circuit 30 as described above. Then, the circulating signal, for example, the output signal of the excitation circuit 10, is picked up as the musical tone signal.

The tone pitch and the tone color of the musical tone depend on the resonance frequency characteristic of the resonance circuit 30. In the case where the tone hole TH is opened, the primary resonance frequency equal to the reciprocal of the total delay time of the delay circuits Dnf and Dnr which are provided between the excitation circuit 10 and the junction unit JTH. Herein, the reflection signal fed back to the excitation circuit 10 includes the component reflected by the terminal circuit TRM and the component circulating via low-pass filter LPFTH corresponding to the terminal portion of the tone hole TH, so that the complicated scattering operation of the compression wave of air to be occurred in the actual clarinet can be really simulated.

[B]SECOND EMBODIMENT

In the wind instrument actually performed, the transmission frequency characteristics of the resonance tube has plural resonance frequencies. Herein, the primary resonance frequency, that is, the lowest one of a plurality of resonance frequencies is determined according to the open/close operation applied to the tone holes. But in the performance of the wind instrument, by adjusting the blowing pressure, the musical tone can be sounded at various kind of pitches, i.e., the primary resonance frequency, the third resonance frequency, the fifth resonance frequency or the another higher harmonic resonance frequency without changing the open/close state of the tone holes.

Figure 4:
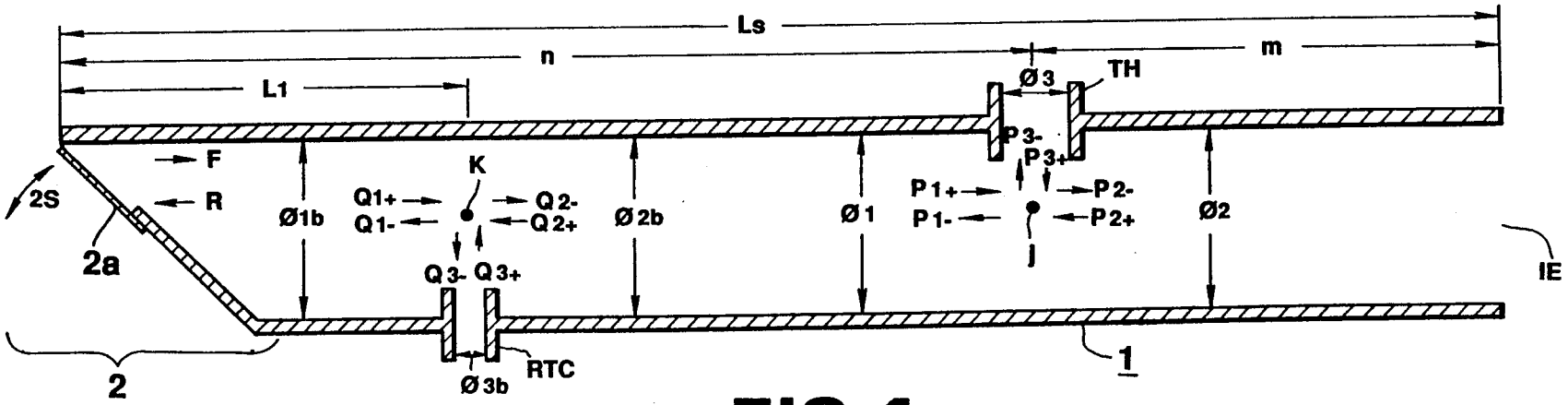
FIG. 4 shows a configuration of a physical model of the wind instrument corresponding to the second embodiment of the present invention.
Figure 3:
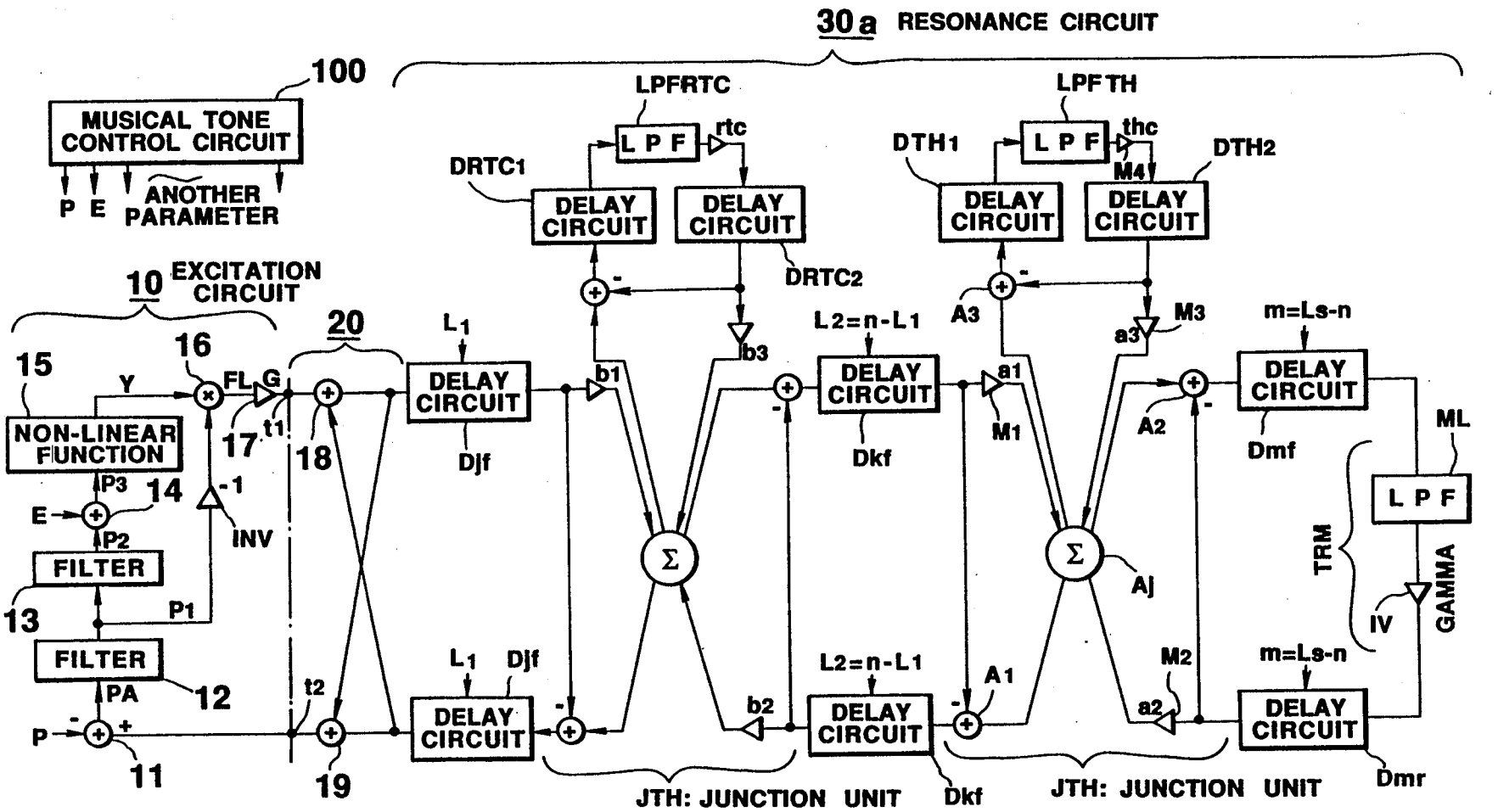
FIG. 3 is a block diagram showing the musical tone synthesizing apparatus according to a second embodiment of the present invention.

In the second embodiment shown in FIG. 3, as a means for assisting the generation of the musical tone at the higher harmonic resonance frequency, a junction unit JRTC is provided in a resonance circuit 30*a*. Herein, parts identical to those in FIG. 1 will be designated by the same numerals, hence, description thereof will be omitted. In FIG. 4, there is shown the physical model of the wind instrument corresponding to the musical tone synthesizing apparatus shown in FIG. 3. Herein, parts identical to those in FIG. 2 will be designated by the same numerals, hence, description thereof will be omitted. The physical model has "a register tube" RTC as means for assisting the generation of the high harmonic tone. In the non-electronic instruments, the wind instrument having the hole corresponding the register tube (generally called octave key) is existed.

The register tube RTC is provided between the mouth piece portion 2 and the tone hole TH in the resonance tube 1. As shown in FIG. 4, the scattering of the compression wave of the air is occurred at the point k in the vicinity of the register tube RTC as similar to the tone hole TH. In the FIG. 4, $Q_{1+}$, $Q_{2+}$, $Q_{3+}$ designate the respective pressures of the compression waves of air which flow into the point k; and $Q_{1-}$, $Q_{2-}$, $Q_{3-}$ designate the respective pressures of the compression waves of air which flow out of the point k.

In FIG. 3, the junction unit JRTC is provided for simulating the scattering of the compression wave corresponding to the register tube RTC. Herein, the multiplication coefficients $b_1$, $b_2$, $b_3$ supplied to the multipliers of the junction unit JRTC are determined based on the diameters $\phi_{1b}$, $\phi_{2b}$, $\phi_{3b}$ corresponding to the register tube RTC. In addition, LPFRTC designates as low-pass filter which simulates the acoustic loss to be occurred at the opening portion of the register tube RTC. The reflection coefficient rtc is varied in response to the open/close operation applied to the register tube RTC. The junction unit JRTC has the same configuration of the junction unit JTH basically, but the coefficients supplied thereto are different from each other, hence, detailed description of the junction unit JRTC will be omitted.

In FIG. 3, the delay time of the delay circuits Djf and Djr are determined according to the propagation delay to be occurred between the reed 2*a* and the register tube RTC. In addition, the delay times of the delay circuits Dkf and Dkr are determined according to the propagation delay between the register tube RTC and the tone hole TH. In short, the delay circuit Dnf shown in FIG. 1 is divided into the delay circuits Djf and Dkf shown in FIG. 3, while the delay circuit Dnr shown in FIG. 1 are divided into the delay circuits Djr and Dkr shown in FIG. 3.

The musical tone synthesizing apparatus shown in FIG. 3 has been designed evaluated with changing the design parameters, i.e., the delay times of the respective delay circuits, the coefficients used for the multipliers and the like. Hereinafter, description will be given with respect to several design examples and evaluation results.

DESIGN EXAMPLE 1

Parameters for filters

| | |
|---|---|
| Cut-off frequency fcTH of the low-pass filter LPFTH corresponding the tone hole TH = | 2500 [Hz] |
| Cut-off frequency fcRTC of the low-pass filter LPFRTC corresponding the register tube RTC = | 7000 [Hz] |
| Cut-off frequency fcML of the low-pass filter ML corresponding the terminal portion 1E = | 2000 [Hz] |
| Cut-off frequency fcdcf of the low-pass filter 13 = | 1500 [Hz] |

The delay time designation data (In this case, shift registers have been used for delay circuits so that each designation data designates the stage number of the shift register to be enabled)

| | |
|---|---|
| The total stage number Ls of the delay circuits Djf, Dkf and Dmf (Djr, Dkr and Dmr) corresponding the total length of the resonance tube 1 = | 82 |
| The stage number LTH of the delay circuits DTH1 and DTH2 each corresponding the height of the tone hole TH. = | 1 |
| The stage number LRTC of the delay circuits $DRTC_1$ and $DRTC_2$ corresponding the height of the register tube RTC. = | 1 |

The parameters corresponding to the tone hole TH $\phi_1=24$ [mm], $\phi_2=24$ [mm], $\phi_3$ has been varied in the range between 8 [mm] and 48 [mm].

The multiplication coefficients $a_{1off}$, $a_{2off}$, $a_{3off}$ have been operated by using the formulae (3) to (5) based on the above given diameter $\phi_1$, $\phi_2$ and $\phi_3$ and the operation results of $a_{1off}$, $a_{2off}$, $a_{3off}$ have been supplied to the junction unit JTH. In addition, the reflection coefficient thc has been set "−1" (corresponds to the case where the tone hole TH is opened).

The parameters corresponding to the register tube RTC $\phi_{1b}=19$ [mm], $\phi_{2b}=19$ [mm], $\phi_{3b}=3$ [mm]

The multiplication coefficients $b_{1off}$, $b_{2off}$, $b_{3off}$ and $b_{1on}$, $b_{2on}$, $b_{3on}$ have been operated based on the above given diameter $\phi_{1b}$, $\phi_{2b}$ and $\phi_{3b}$. The operated results of $b_{1off}$, $b_{2off}$, $b_{3off}$ have been supplied to the junction unit JRTC during synthesizing the musical tone corresponding to the case where the register tube RTC is opened. The operated results of $b_{1on}$, $b_{2on}$, $b_{3on}$ have been supplied to the junction unit JRTC during synthesizing the musical tone corresponding the case where the register tube RTC is closed. In addition, the reflection coefficient thc has been set "1" in the case where the register tube RTC is closed and has been set "−0.9" in the case where the register tube RTC is opened.

Other parameters

| | |
|---|---|
| The multiplication coefficient GAMMA of the multiplier IV (reflection coefficient of the terminal portion 1E) = | −0.9 |
| The multiplication coefficient G of the multiplier 17 (corresponding to the impedance of air flow of the tube 1) = | 0.3 |

Variation of parameters for evaluation

The multiplication coefficient rtc for the junction unit JRTC, the delay time designation data $L_1$ for the delay circuit Djf (Djr) corresponding to the length between the reed 2*a* and the register tube RTC, the delay time designation data n of the delay circuit Djf and Dkf (Djr and Dkr) corresponding to the length between the reed 2*a* and the tone hole TH, and the diameter $\phi_3$ of the tone hole TH have been varied and set in accordance with the respective condition shown in table-1 and the synthesizing the musical tone has been evaluated.

TABLE 1

Figure 5A:
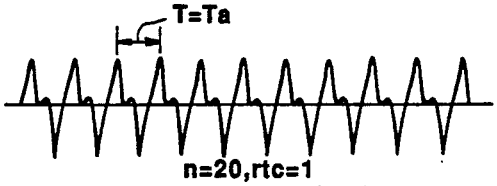
FIGS. 5(*a*) to 5(*h*) show oscillation wave-forms of the resonance circuit of the second embodiment of the present invention.
Figure 5B:
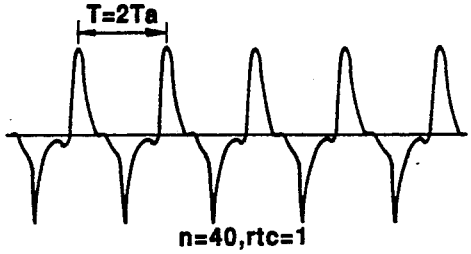
Figure 5C:
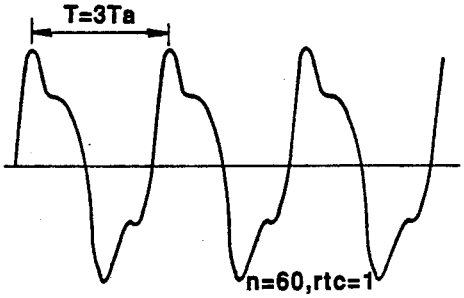
Figure 5D:
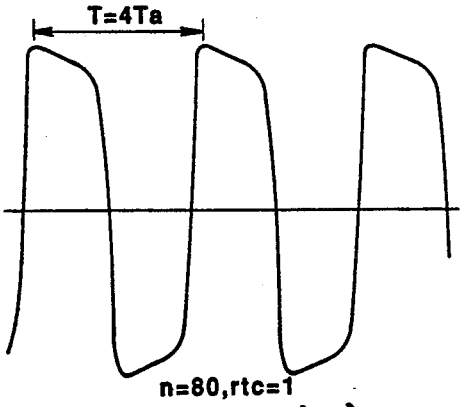
Figure 5E:
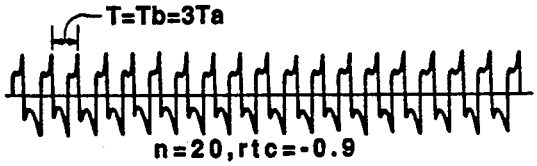
Figure 5F:
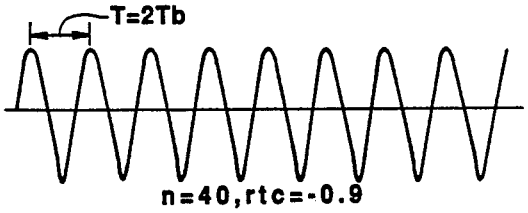
Figure 5G:
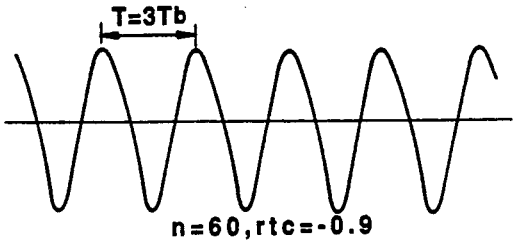
Figure 5H:
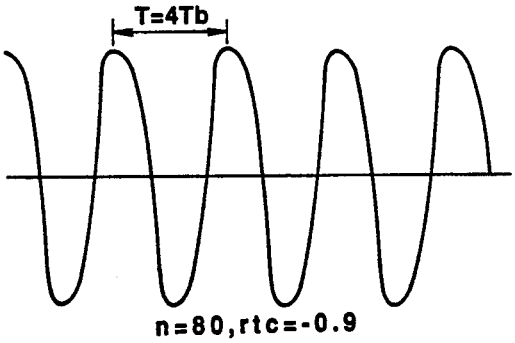

| | | The variation of the parameters | | |
|---|---|---|---|---|
| rtc | n | $L_1$ | $\phi_3$ [mm] | Oscillation wave form |
| 1 | 20 | 5 | 32 | FIG. 5(a) |
| | 40 | 10 | 16 | FIG. 5(b) |
| | 60 | 15 | 10 | FIG. 5(c) |
| | 80 | 20 | 8 | FIG. 5(d) |
| −0.9 | 20 | 5 | 48 | FIG. 5(e) |
| | 40 | 10 | 16 | FIG. 5(f) |
| | 60 | 15 | 10 | FIG. 5(g) |
| | 80 | 20 | 8 | FIG. 5(h) |

In this evaluation, as shown in table-1, the delay time designation data $L_1$ has been set a quarter of the delay time designation data n, and the diameter $\phi_3$ of the tone hole TH has been set so as to decrease according to the increasing of data n. In addition, in the case where rtc=−0.9 and n=20, the cut-off frequency fcTH of low-pass filter LPFTH has been set 4000 [Hz], and the cut-off frequency fcdcf of low-pass filter 13 has been set 4000 [Hz]. As a result, the oscillation wave forms shown in FIGS. 5(*a*) to (*h*) have been obtained from the resonance circuit 30*a* by setting the respective conditions shown in table-1. The oscillation wave form in the case where rtc=1, i.e., the register tube RTC is closed is shown in FIGS. 5(*a*) to (*d*). As shown in these drawings, the oscillation period T increases as Ta→2Ta→3-Ta→4Ta according to the increasing of the delay time designation data n as 20→40→60→80. On the other hand, the oscillation waveform in the case where rtc=−0.9, i.e., the register tube RTC is opened is shown in FIGS. 5(*e*) to (*h*). In this case, as shown these drawing, the oscillation period T also increases according to the increasing of the delay time designation data n. Herein, compare the wave forms shown in FIGS. 5(*a*) to (*d*) with the wave forms shown in FIGS. 5(*e*) to (*h*) in the same condition of the delay time designation data n. For example, comparing the waveform shown in FIG. 5(*e*) which corresponds the condition of rtc=−0.9, n=20 with the waveform shown in FIG. 5(*a*) which corresponds the condition of rtc=1, n=20, the oscillation period Tb of the waveform shown in FIG. 5(*e*) is ⅓ of the oscillation period Ta of the waveform shown in FIG. 5(*a*). Comparing the wave form conditioned by another delay time designation data n, i.e., comparing FIG. 5(*f*) with FIG. 5(*b*), FIG. 5(*g*) with FIG. 5(*c*), and FIG. 5(*h*) with FIG. 5(*d*), the similar results are obtained. Thus, it is shown that the oscillation period T decreases by opening the register tube RTC. It has been recognized that the pitch of musical tone can be valuable among the 3.5 octave in this embodiment.

DESIGN EXAMPLE 2

Parameters of filters fcTH=2500 [Hz], fcRTC=7000 [Hz], fcML=2000 [Hz], fcdcf=1500 [Hz]

The delay time designation data

Ls=82, n=40, $L_1$=10
LTH=1, LRTC=1

The parameters corresponding to the tone hole TH $\phi_1$=24 [mm], $\phi_2$=24 [mm], $\phi_3$=16 [mm]

The multiplication coefficients $a_{1off}$, $a_{2off}$, $a_{3off}$ have been operated based on the above given diameter $\phi_1$, $\phi_2$ and $\phi_3$ and the operation results of $a_{1off}$, $a_{2off}$, $a_{3off}$ have been supplied to the junction unit JTH. In addition, setting the reflection coefficient thc to "−1", the evaluation has be done.

The parameters corresponding to the register tube RTC $\phi_{1b}$=19 [mm], $\phi_{2b}$=19 [mm], $\phi_{3b}$=3 [mm]

The multiplication coefficients $b_{1off}$, $b_{2off}$, $b_{3off}$ and $b_{1on}$, $b_{2on}$, $b_{3on}$ have been operated based on the above given diameter $\phi_{1b}$, $\phi_{2b}$ and $\phi_{3b}$. The operation results of $b_{1off}$, $b_{2off}$, $b_{3off}$ have been supplied to the junction unit JRTC during the synthesizing the musical tone corresponding the case where the register tube RTC is opened. And the operation results of $b_{1on}$, $b_{2on}$, $b_{3on}$ have been supplied to the junction unit JRTC during the synthesizing the musical tone corresponding the case where the register tube RTC is closed.

Other parameters

| | |
|---|---|
| The multiplication coefficient GAMMA of the multiplier IV = | −0.9 |
| The multiplication coefficient G of the multiplier 17 = | 0.3 |

The variation of parameters for the evaluation

In the above condition, being changed the reflection coefficient rtc of the junction unit JRTC variously, the characteristic evaluation of the resonance circuit 30*a* shown in FIG. 3 has been carried out.

Evaluation result

Figure 6A:
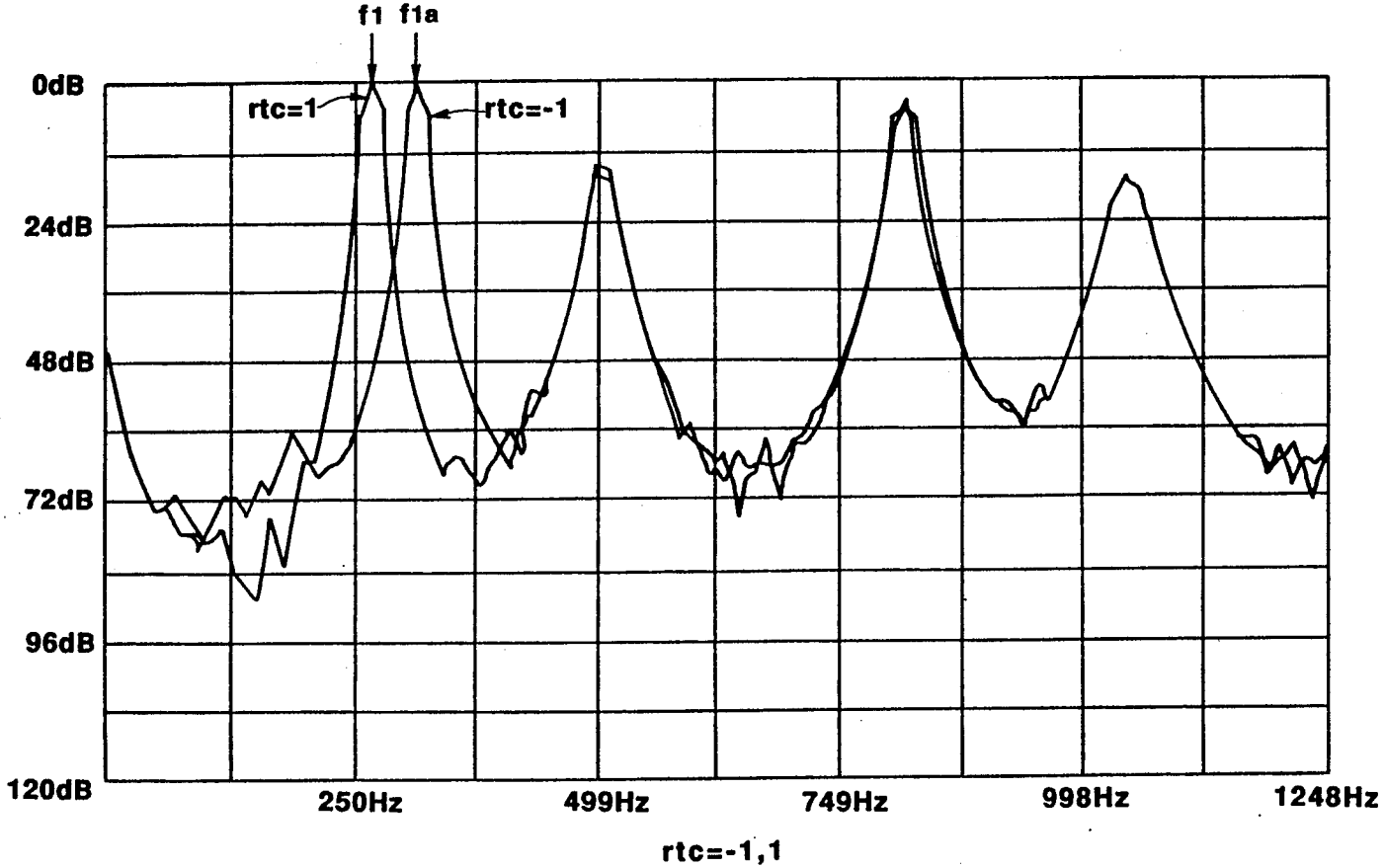
FIGS. 6(*a*) and 6(*b*) to 10(*a*) and 10(*b*) show transmission frequency characteristics of the resonance circuit of the second embodiment of the present invention.
Figure 6B:
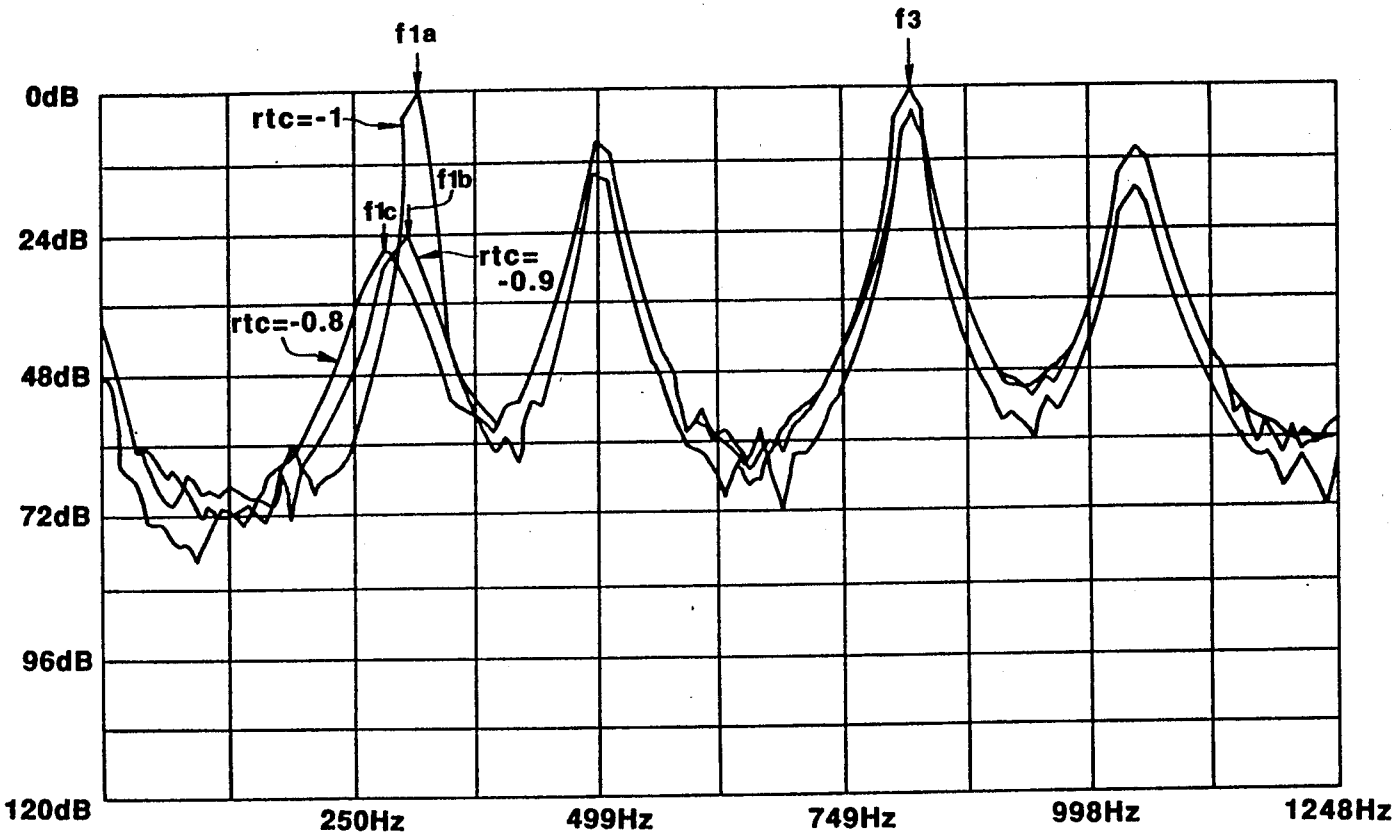

Preceding the evaluation, the junction unit 20 and the resonance circuit 30*a* has been separated from the excitation circuit 10 at points $t_1$ and $t_2$. In the evaluation, supplying an impulse signal through the point $t_1$ toward the resonance circuit 30*a*, the impulse response from the resonance circuit 30*a* has be observed through the point $t_2$. And the FFT (Fast Fourier Transform) for the obtained impulse response has been executed. As the result of the above processing, transmission frequency characteristics of the resonance circuit 30*a* shown in FIGS. 6(*a*) and (*b*) have been obtained. As shown in FIG. 6(*a*), in the case where rtc=1 (the register tube RTC is opened), transmission gain of the resonance circuit becomes maximum at the primary resonance frequency $f_1$. Thus, the musical tone syntheesizing apparatus shown in FIG. 3 resonates with the primary resonance frequency $f_1$. Herein, if the reflection coefficient rtc has been changed to "−1" from "1" without changing another condition, the primary resonance frequency only shifts to the frequency $f_{1a}$ which is a little higher than the frequency $f_1$. However, since the transmission gain of the resonance circuit 30*a* becomes maximum at the frequency $f_{1a}$, the resonance with the high harmonic frequency cannot be occurred, though the register tube RTC is opened. Then, changing the reflection coefficient rtc to −0.9 or −0.8 from −1, the evaluation has been carried out. As the result, the transmission frequency characteristics shown in FIG. 6(*b*) have been obtained. As shown in drawing, in the case where rtc=−0.8 or −0.9, the transmission gain at the primary resonance frequency $f_{1b}$ and $f_{1c}$ respectively corresponding to the above case, become lower than the transmission gain in the case where rtc=−1. Thus, the transmission gain of the resonance circuit 30*a* is maximum at the third harmonic resonance frequency $f_3$. As the result of the above evaluation, it is confirmed that by using a reflection coefficient for which the absolute value is smaller than "1", that is, by supplying the reflection coefficient including the attenuation coefficient to the junction unit JRTC, the resonance circuit 30*a* can resonate easily at the higher harmonic resonance frequency, in the case where the register tube RTC is opened.

In the musical tone synthesizing apparatus of the design example 2, the reflection coefficient of the junction unit JRTC corresponding to the case where the register tube RTC is opened is determined based on above evaluation. Thus, in the case where the register tube RTC is opened, the resonance circuit 30*a* resonates at the primary resonance frequency determined based on the total delay time of the delay circuits provided between the excitation circuit 10 and the junction unit JTH, thus, a musical tone having the primary resonance frequency is synthesized. In addition, in the case where the register tube RTC is closed, by supplying the minus coefficient rtc including the attenuation coefficient to the junction unit JRTC, the resonance circuit 30*a* resonates at the high harmonic resonance frequency where the maximum transmission gain is obtained, thus, the musical tone having the higher harmonic resonance frequency is synthesized.

DESIGN EXAMPLE 3

Parameters for filters fcTH=2500 [Hz], fcRTC=7000 [Hz], fcML=2000 [Hz], fcdcf=1500 [Hz]

The delay time designation data

Ls=82, n=40, $L_1$=10
LTH=1, LRTC=2

The parameters corresponding to the tone hole TH $\phi_1$=24 [mm], $\phi_2$=24 [mm], $\phi_3$=16 [mm]

The multiplication coefficients $a_{1off}$, $a_{2off}$, $a_{3off}$ have been operated based on the above given diameter $\phi_1$, $\phi_2$ and $\phi_3$ and the operation results of $a_{1off}$, $a_{2off}$, $a_{3off}$ have been supplied to the junction unit JTH.

The parameters corresponding to the register tube RTC $\phi_{1b}$=19 [mm], $\phi_{2b}$=19 [mm], $\phi_{3b}$=3 [mm]

The multiplication coefficients $b_{1off}$, $b_{2off}$, $b_{3off}$ and $b_{1on}$, $b_{2on}$, $b_{3on}$ have been operated based on the above given diameter $\phi_{1b}$, $\phi_{2b}$ and $\phi_{3b}$. The operation results of $b_{1off}$, $b_{2off}$, $b_{3off}$ and the reflection coefficient rtc=−1 have been supplied to the junction unit JRTC during the synthesizing the musical tone in the case where the register tube RTC is opened. And the operation results of $b_{1on}$, $b_{2on}$, $b_{3on}$ and the reflection coefficient rtc=1 have been supplied to the junction unit JRTC during the synthesizing the musical tone in the case where the register tube RTC is closed.

Other parameters

| | |
|---|---|
| The multiplication coefficient GAMMA of the multiplier IV = | −0.9 |
| The multiplication coefficient G of the multiplier 17 = | 0.3 |

The variation of parameters for the evaluation

In the above condition, having changed the reflection coefficient thc used for the junction unit JTH variously, the characteristic evaluation of the resonance circuit 30*a* shown in FIG. 3 has been carried out.

Evaluation result

Figure 7A:
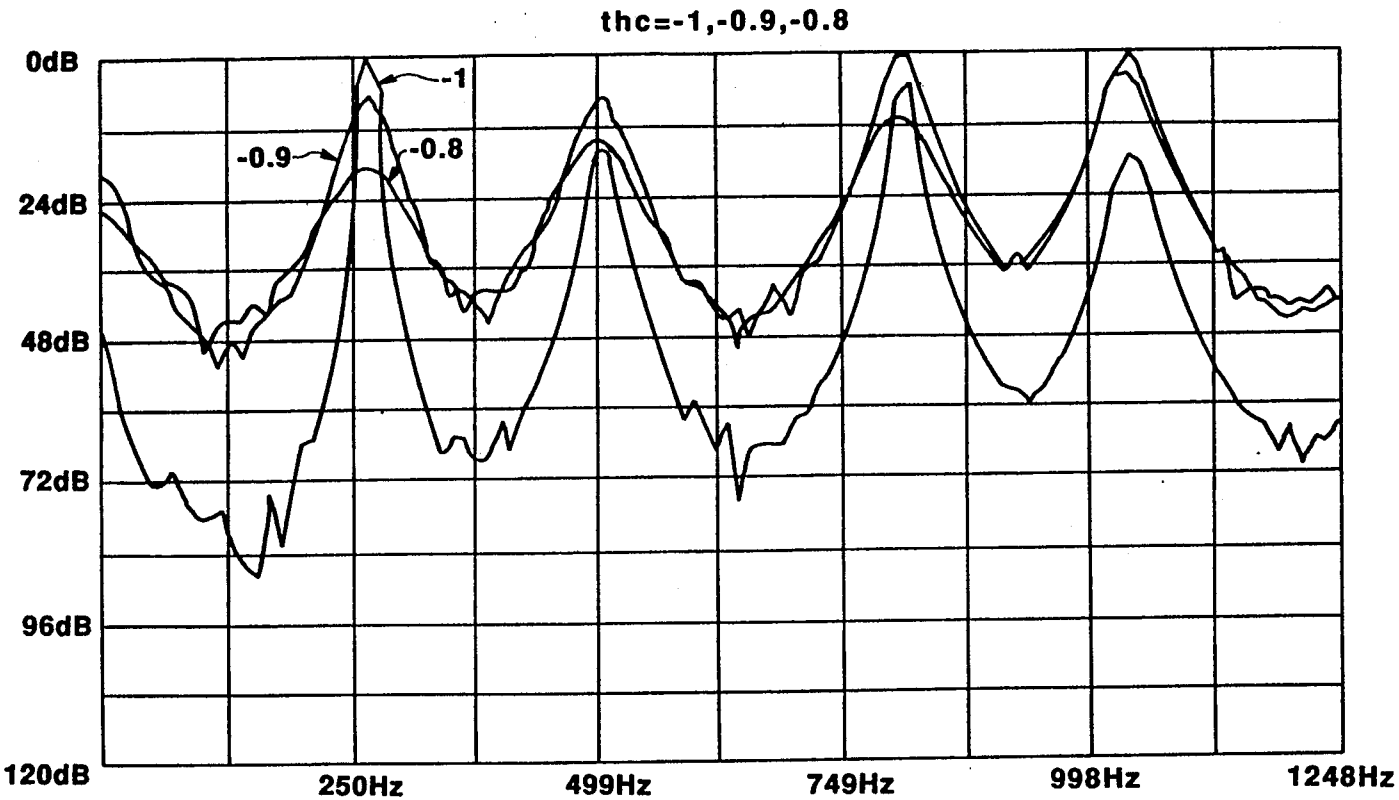
Figure 7B:
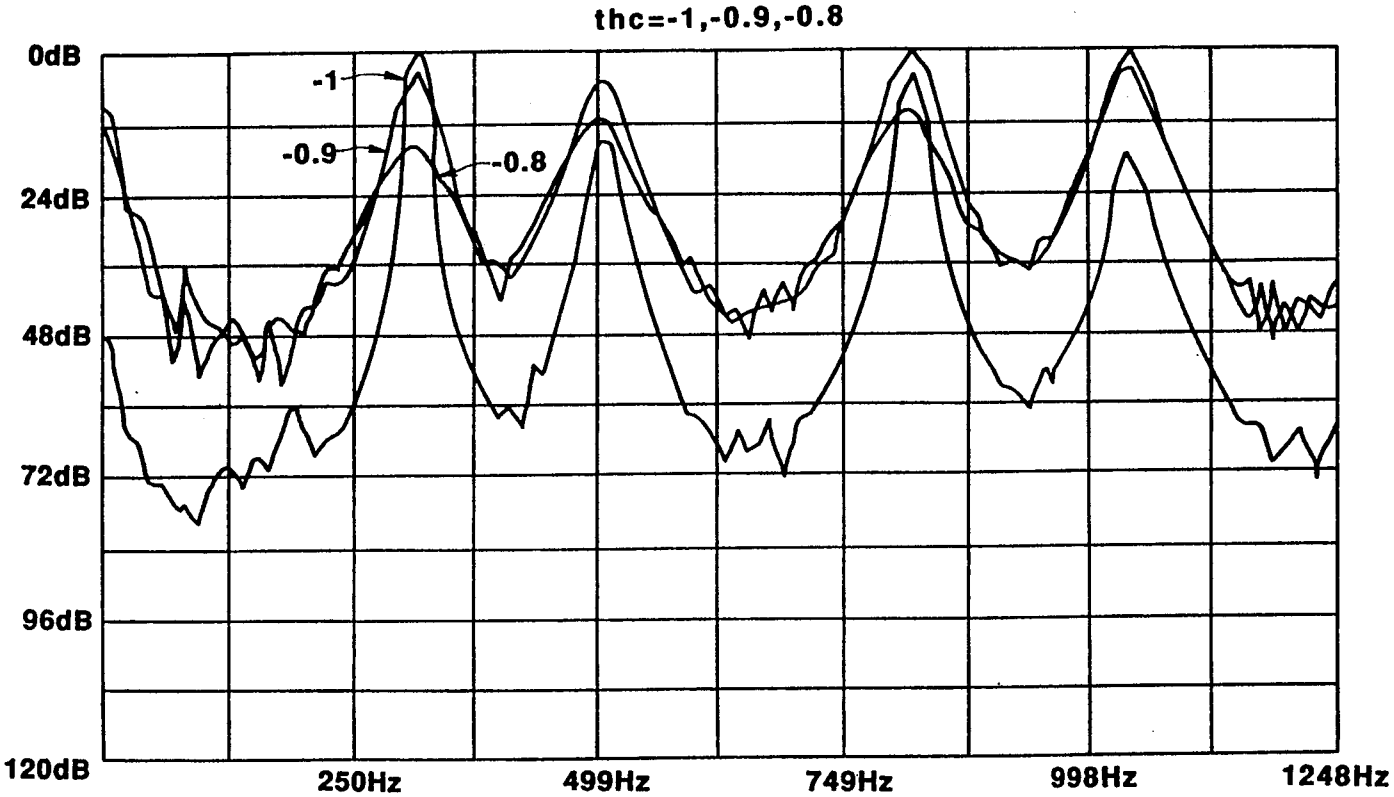

The evaluation has been carried out with the manner similar to the evaluation of the design sample 2. As the result, the transmission frequency characteristics of the resonance circuit 30*a* shown in FIGS. 7(*a*) and (*b*) has been obtained. Herein, FIG. 7(*a*) shows the transmission frequency characteristics in the case where rtc=1 (the register tube RTC is opened), and FIG. 7(*b*) shows the transmission frequency characteristics in the case where rtc=−1 (the register tube RTC is opened). As shown in the drawings, according to decrease the absolute value of the reflection coefficient thc for the junction unit JTH such as −1→−0.9→−0.8, the pass band width of the each resonance frequency becomes wide, that is, the resonance selectivity Q at each resonance frequency become smaller.

In the musical tone synthesizing apparatus of the design example 3, to synthesize the musical tone in the case where the tone hole TH is opened, the reflection coefficient thc of the junction unit JTH can be varied by musical tone control circuit 100 based on the operation of the manual operating member (not shown) so that the resonance selectivity Q of the resonance circuit 30*a* can be controlled. Thus, during the performance, the performer can vary the distribution of the frequency components included in the musical tone to be synthesized so that the various tone color of the musical tone are obtained from the apparatus based on the operation of the manual operating member.

DESIGN EXAMPLE 4

Parameters for filters fcTH=2500[Hz], fcRTC=7000[Hz], fcML=2000[Hz]
fcdcf=1500[Hz]

The delay time designation data

Ls=82, n=40, $L_1$=10
LTH=1, LRTC=2

The parameters for the register tube RTC $\phi_{1b}$=19[mm], $\phi_{2b}$=19[mm], $\phi_{3b}$=3[mm]

The multiplier coefficients $b_{1off}$, $b_{2off}$, $b_{3off}$ and $b_{1on}$, $b_{2on}$, $b_{3on}$ have been operated based on the above given diameter $\phi_{1b}$, $\phi_{2b}$ and $\phi_{3b}$. The operation results of $b_{1off}$, $b_{2off}$, $b_{3off}$ and the reflection coefficient rtc=1 have been supplied to the junction unit JRTC during synthesizing the musical tone in the case where the register tube RTC is opened. And the operation results of $b_{1on}$, $b_{2on}$, $b_{3on}$ and the reflection coefficient rtc=1 have been supplied to the junction unit JRTC during synthesizing the musical tone in the case where the register tube RTC is closed.

Other parameters

| | |
|---|---|
| The multiplication coefficient GAMMA of the multiplier IV = | −0.9 |
| The multiplication coefficient G of the multiplier 17 = | 0.3 |

The variation of parameters for the evaluation

In setting the parameters above mentioned and setting the diameters $\phi_1$, $\phi_2$ of the both side of the resonance tube 1 to 24[mm], the diameter $\phi_3$ of the tone hole TH has been varied in three cases, that is, the first case of $\phi_3$=8[mm], the second case of $\phi_3$=16[mm] and the third case of $\phi_3$=48[mm]. Then, with respect to the respective cases, the multiplication coefficient $a_{1off}$, $a_{2off}$, $a_{3off}$ has been operated based on the respective diameters $\phi_1$, $\phi_2$, $\phi_3$ and the operated results has been supplied to the junction unit JTH. In addition, the reflection coefficient thc has been set "−1" (the case where the tone hole TH is opened). In this condition, the characteristic evaluation of the resonance circuit 30*a* shown in FIG. 3 has been carried out.

Evaluation result

The evaluation has been carried out with the manner similar to the evaluation of the design sample 2. As the result, the transmission frequency characteristics of the resonance circuit 30*a* shown in FIGS. 8(*a*) and (*b*) has be obtained. Herein, FIG. 8(*a*) shows the transmission frequency characteristics in the case where rtc=1 (the register tube RTC is closed), and FIG. 8(*b*) shows the transmission frequency characteristics in the case where rtc=−1 (the register tube RTC is opened). As shown in the drawings, according to increase the diameter $\phi_3$ of the tone hole TH such as 8[mm]→16[mm]→48[mm], the peak values of transmission gain at the primary resonance frequency and the secondary resonance frequency become lower. In addition, taking notice of the balance of the transmission gain among the each resonance frequency, for example, the transmission gain at the primary resonance frequency $f_{1a}$ and $f_{1b}$ is maximum in the case where $\phi_3$=8[mm], however, in the case where $\phi_3$=48[mm], the transmission gain at the third resonance frequency $f_{3a}$ and $f_{3b}$ is maximum. Thus, the evaluation result shows that by changing the diameter of the tone hole TH, the resonance frequency in which the maximum transmission gain is obtained can be exchanged.

In the musical tone synthesizing apparatus of the design example 4, in the case where the register tube RTC is closed, the multiplication coefficient $a_{1off}$, $a_{2off}$, $a_{3off}$ are operated based on the hypothetical diameter smaller than the actual diameter $\phi_3$ of the tone hole TH and operated results are supplied to the junction unit JTH so that the musical tone of the primary resonance frequency can be easily synthesized. Other hand, in the case where the register tube RTC is opened, the multiplication coefficient $a_{1off}$, $a_{2off}$, $a_{3off}$ are operated based on the hypothetical diameter bigger than the actual diameter $\phi_3$ of the tone hole TH and the operation results are supplied to the junction unit JTH so that the musical tone of the third resonance frequency can be easily synthesized.

Figure 8A:
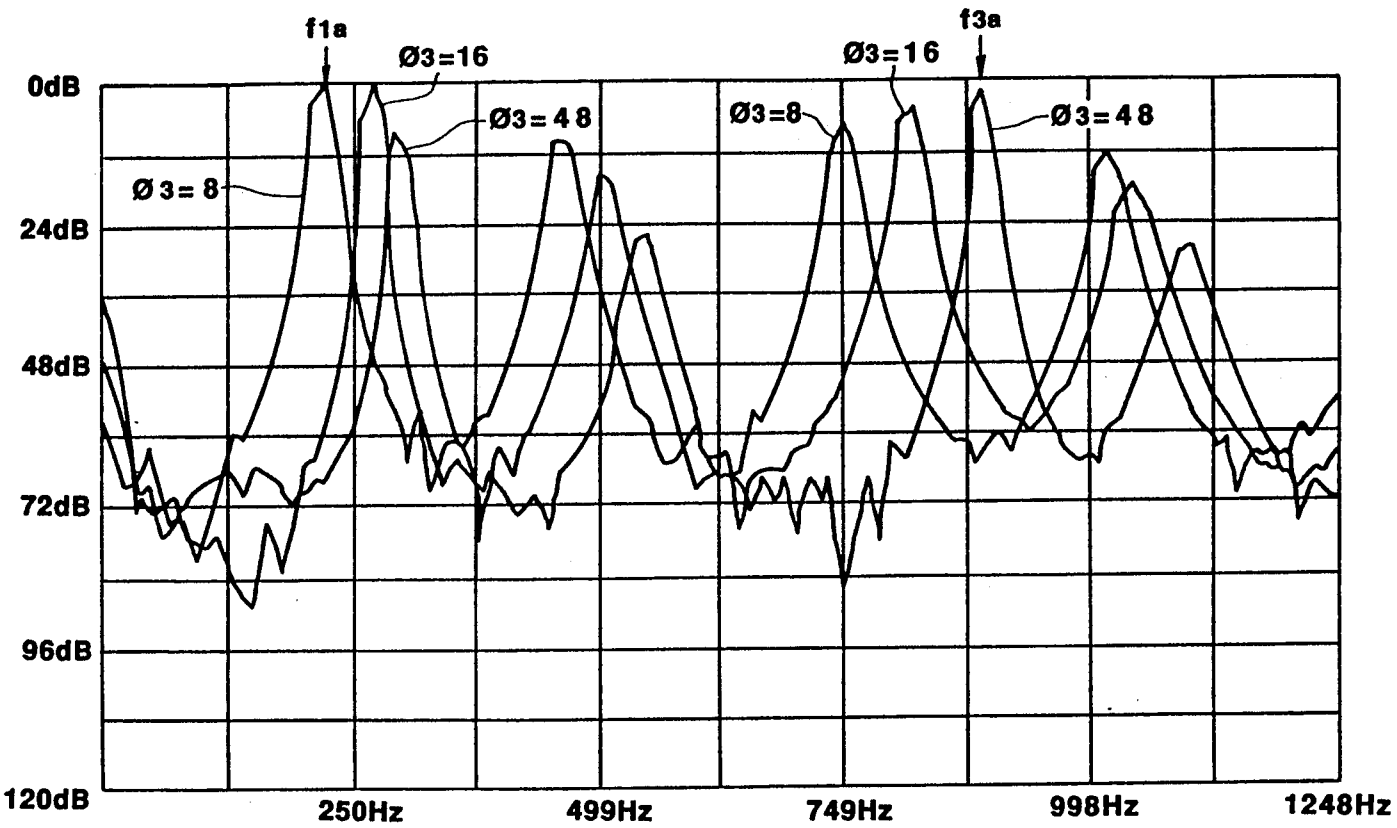
Figure 8B:
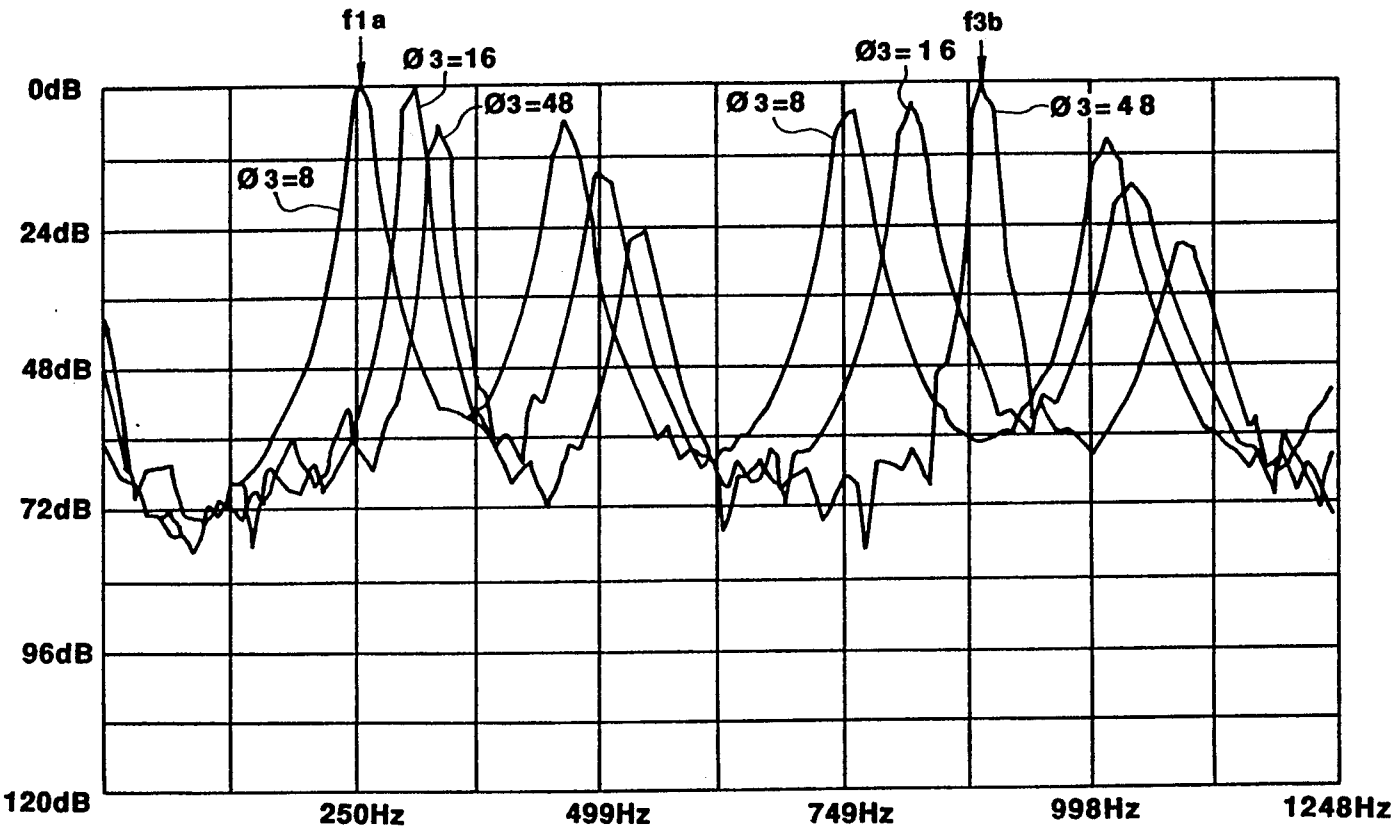

Herein, the problem is caused that the resonance frequency of the resonance circuit 30*a* becomes higher according to increase the diameter $\phi_3$ as shown in FIGS. 8(*a*) and 8(*b*). However, the problem can be solved by adjusting the balance between the respective delay times of the delay circuits Dnf, Dmf, Dmr, Dnr, Djf, Dkf, Dkr, Djr to obtain the target resonance frequency.

DESIGN EXAMPLE 5

Parameters for filters fcTH=2500[Hz], fcRTC=7000[Hz], fcML=2000[Hz]

fcdcf=1500[Hz]

The delay time designation data

Ls=82, n=40, $L_1$=10
LRTC=2

The parameters corresponding to the tone hole TH $\phi_1$=24[mm], $\phi_2$=24[mm], $\phi_3$=16[mm]

The multiplier coefficients $a_{1off}$, $a_{2off}$, $a_{3off}$ have been operated based on the above given diameter $\phi_1$, $\phi_2$, $\phi_3$ and the operation results of $a_{1off}$, $a_{2off}$, $a_{3off}$ have been supplied to the junction unit JTH. In addition, the reflection coefficient thc=−1 for the case when the tone hole TH is opened is supplied to the junction unit JTH.

The parameters corresponding to the register tube RTC $\phi_{1b}$=19[mm], $\phi_{2b}$=19[mm], $\phi_{3b}$=3[mm]

The multiplier coefficients $b_{1off}$, $b_{2off}$, $b_{3off}$ and $b_{1on}$, $b_{2on}$, $b_{3on}$ have been operated based on the above given diameters $\phi_{1b}$, $\phi_{2b}$, $\phi_{3b}$. The operation results of $b_{1off}$, $b_{2off}$, $b_{3off}$ and the reflection coefficient rtc=−1 have been supplied to the junction unit JRTC during the synthesizing the musical tone corresponding the case where the register tube RTC is opened. And the operation results of $b_{1on}$, $b_{2on}$, $b_{3on}$ and the reflection coefficient rtc=1 have been supplied to the junction unit JRTC during the synthesizing the musical tone corresponding the case where the register tube RTC is closed.

Other parameters

| | |
|---|---|
| The multiplication coefficient GAMMA of the multiplier IV = | −0.9 |
| The multiplication coefficient G of the multiplier 17 = | 0.3 |

The variation of parameters for the evaluation

In the above condition, being changed the delay time designation data LTH for the delay circuits $DTH_1$ and $DTH_2$ of the junction unit JTH variously, the characteristic evaluation of the resonance circuit 30*a* shown in FIG. 3 has been carried out.

Evaluation results

Figure 9A:
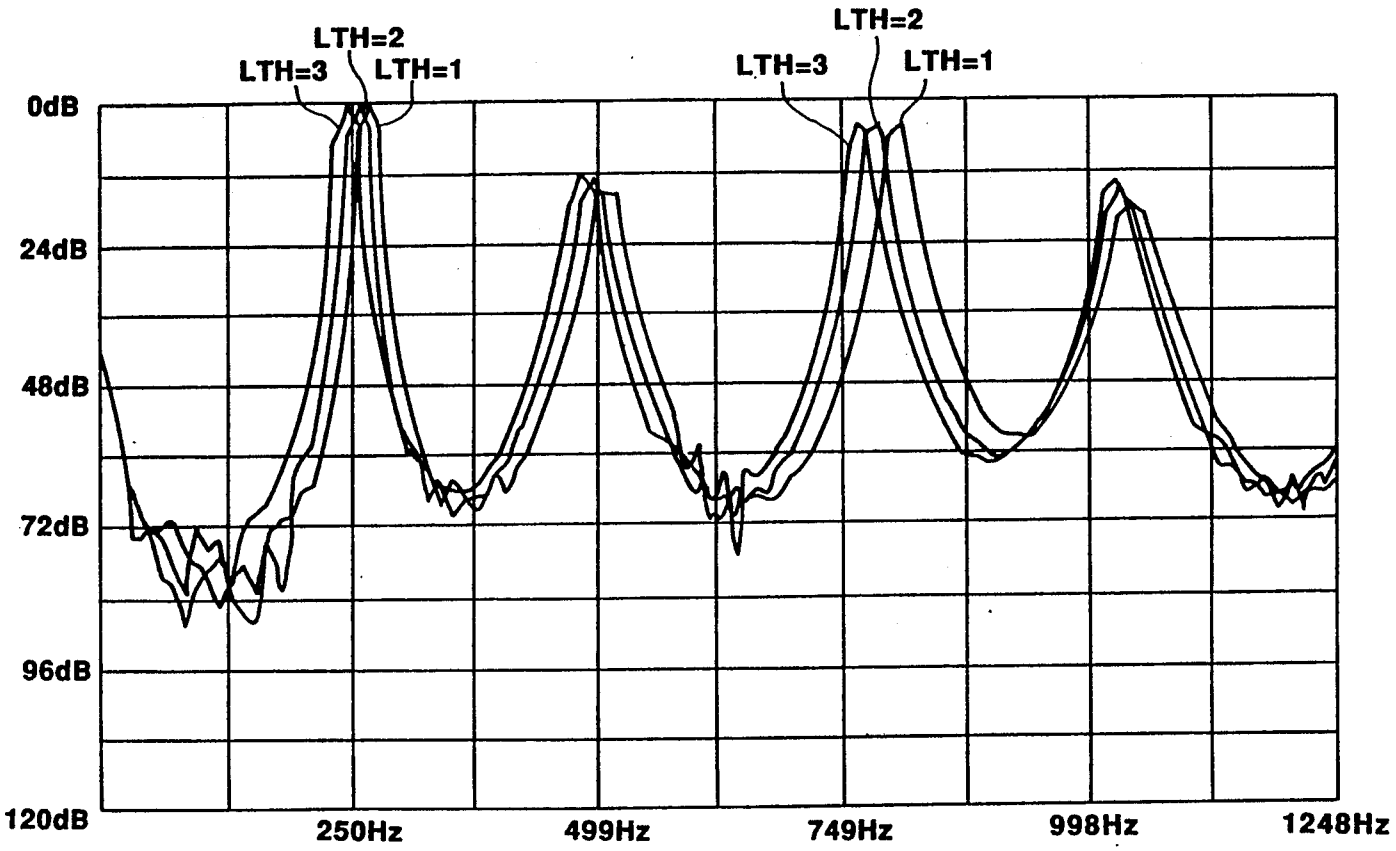
Figure 9B:
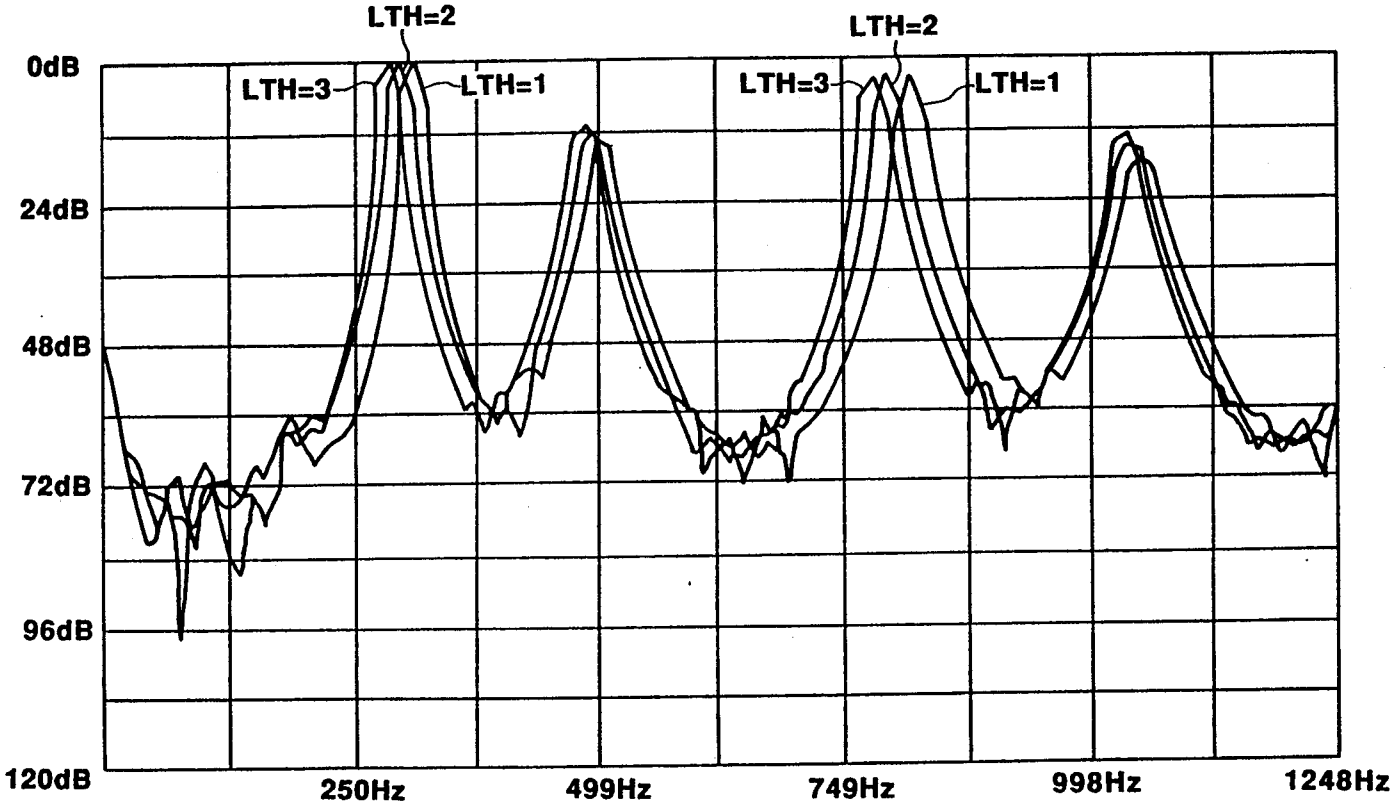

The evaluation has been carried out in a manner similar to the evaluation of the design sample 2. As the result, the transmission frequency characteristics of the resonance circuit 30*a* shown in FIGS. 9(*a*) and (*b*) have been obtained. Herein, FIG. 9(*a*) shows the transmission frequency characteristics in the case where rtc=1 (the register tube RTC is opened), and FIG. 9(*b*) shows the transmission frequency characteristics in the case where rtc = −1 (the register tube RTC is opened). As shown in the drawings, according to increase the delay time designation data LTH applied to the junction unit JTH such as 1→2→3, each resonance frequency becomes smaller.

In the musical tone synthesizing apparatus of the design example 5, the manual operating member for adjusting the tone pitch (not shown) is provided. The delay time designation data LTH can be controlled by the tone control circuit 100 based on the operation of the member. Thus, during the performance, the performer can adjust the tone pitch of the musical tone to be synthesized.

DESIGN EXAMPLE 6

Parameters for filters fcTH = 2500[Hz], fcRTC = 7000[Hz], fcML = 2000[Hz]
fcdcf = 1500[Hz]

The delay time designation data

Ls = 82, n = 40, $L_1$ = 10
LTH = 1, LRTC = 2

The parameters corresponding to the tone hole TH $\phi_1$ = 24[mm], $\phi_2$ = 24[mm], $\phi_3$ = 16[mm]

The multiplication coefficients $a_{1off}$, $a_{2off}$, $a_{3off}$ have been operated based on the above given diameters and the operation results of $a_{1off}$, $a_{2off}$, $a_{3off}$ have been supplied to the junction unit JTH. In addition, the reflection coefficient thc = −1 in the case where the tone hole TH is opened.

The parameters corresponding to the register tube RTC $\phi_{1b}$ = 19[mm], $\phi_{2b}$ = 19[mm], $\phi_{3b}$ = 3[mm]

The multiplication coefficients $b_{1off}$, $b_{2off}$, $b_{3off}$ and $b_{1on}$, $b_{2on}$, $b_{3on}$ have been operated based on the above given diameters. The operation results of $b_{1off}$, $b_{2off}$, $b_{3off}$ and the reflection coefficient rtc = −1 have been supplied to the junction unit JRTC during synthesizing the musical tone in the case where the register tube RTC is opened. In addition, the operation results of $b_{1on}$, $b_{2on}$, $b_{3on}$ and the reflection coefficient rtc = 1 have been supplied to the junction unit JRTC during synthesizing the musical tone in the case where the register tube RTC is closed.

Other parameters

| | |
|---|---|
| The multiplication coefficient G of the multiplier 17 = | 0.3 |

Variation of parameters for the evaluation

In the above condition, being changed the reflection coefficient GAMMA applied to the multiplier IV of the terminal circuit TRM variously, the characteristic evaluation of the resonance circuit 30*a* shown in FIG. 3 has been carried out.

Evaluation results

The evaluation has been carried out in a manner similar to the above mentioned evaluations. As the result, the transmission frequency characteristics of the resonance circuit 30*a* shown in FIGS. 10(*a*) and 10(*b*) has be obtained. Herein, FIG. 10(*a*) shows the transmission frequency characteristics in the case where rtc = 1 (the register tube RTC is closed), and FIG. 10(*b*) shows the transmission frequency characteristics in the case where rtc = −1 (the register tube RTC is opened).

Meanwhile, the total transmission frequency characteristics between the point $t_1$ and the point $t_2$ includes the multiple transmission frequency characteristics. The one is the transmission frequency characteristics corresponding to the path between the point $t_1$ and the point $t_2$ via the junction unit JTH. The other is the transmission frequency characteristics corresponding to the path between the point $t_1$ and the point $t_2$ via the terminal circuit TRM. It can be thought that the even order resonance frequency, for example $f_2$, $f_4$ shown in FIGS. 10(*a*) and 10(*b*), correspond to the path via the terminal circuit TRM.

Figure 10A:
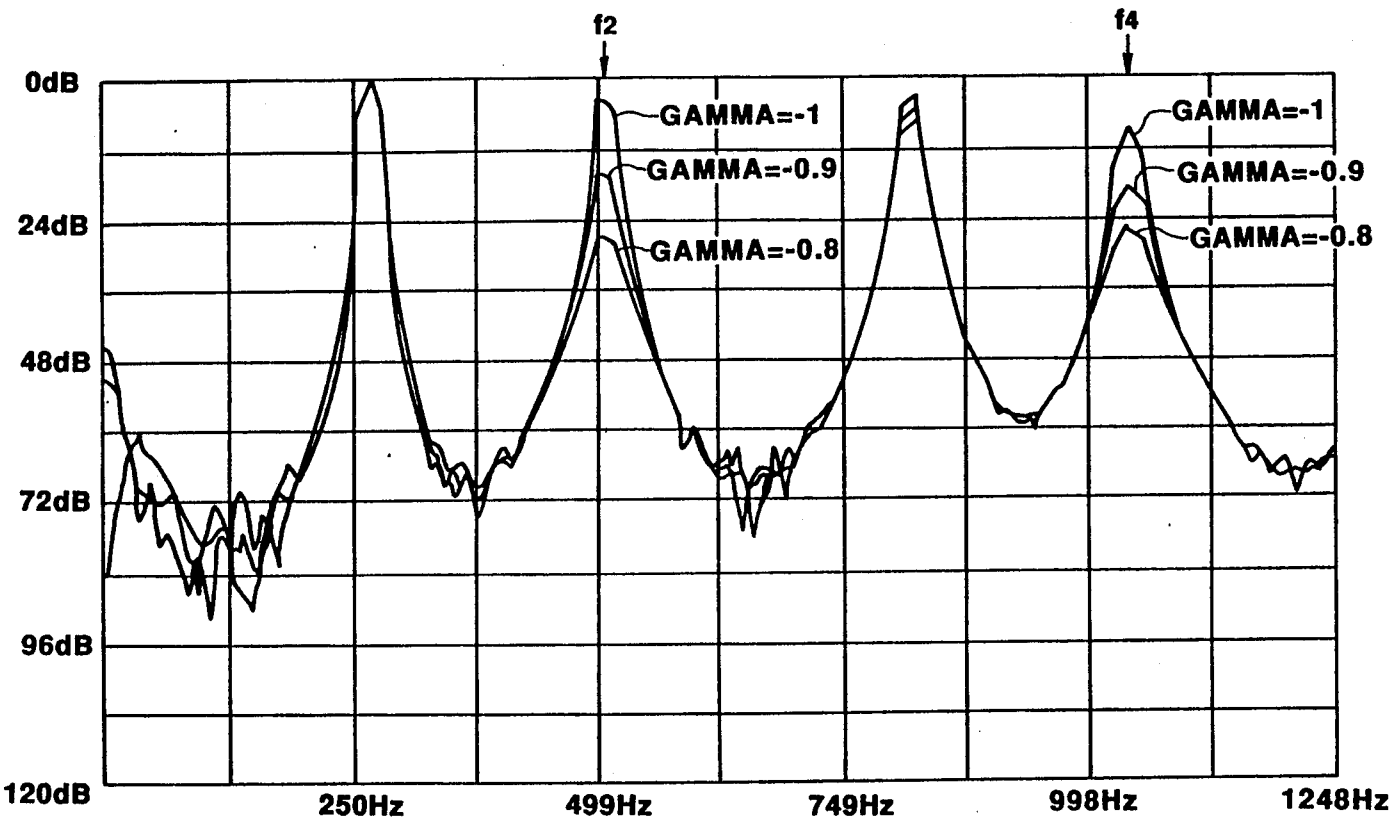
Figure 10B:
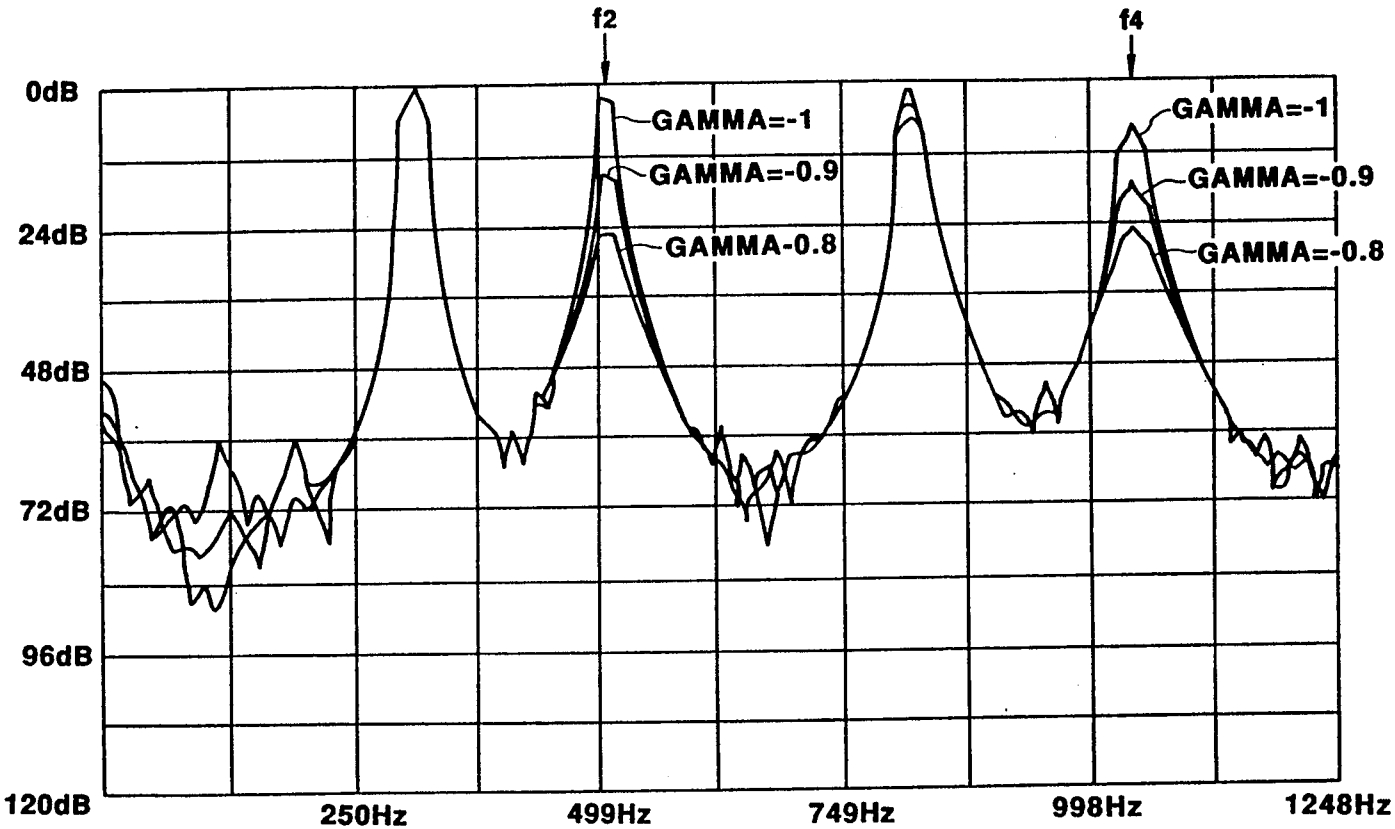

As shown in FIGS. 10(*a*) and 10(*b*), according to decrease the absolute value of the reflection coefficient GAMMA such as −1→−0.9→−0.8, the transmission gain at the even order resonance frequency, for example $f_2$, $f_4$ become smaller respectively but the transmission gain at the odd order resonance frequency not change.

In the musical tone synthesizing apparatus of the design example 6, in response to the open/close operation applied to the tone hole TH, the reflection coefficient GAMMA for the terminal circuit TRM can be changed. More specifically, in the case where the tone hole TH is opened, the reflection coefficient GAMMA having the relatively small absolute value is supplied to the multiplier IV so that the musical tone to be synthesized is limited in the level of the even order resonance frequency components which is not necessary when simulating the wind instrument.

The present invention is especially effective for the simulation of wind instruments. But, by changing the characteristics of the elements which are used for the musical tone synthesizing apparatus according to the present invention i.e., the transmission frequency characteristics of filters, non-linear function table stored in ROM and the parameters of the other elements, plural varied musical tones which cannot be obtained by usual wind instrument can be synthesized.

What is claimed is:

1. A musical tone synthesizing apparatus for simulating a wind instrument, comprising:

excitation means for producing an excitation signal based on an input signal and a reflected wave signal;

resonance means including:

(a) bi-directional transmission means having a delay time for propagating said excitation signal in a forward direction as a progressive wave signal and also propagating a signal corresponding to the excitation signal in a backward direction as said reflected wave signal, (b) delay means located in the bi-directional transmission means for delaying at least one of the progressive wave signal and the reflected wave signal by a delay time;

(c) junction unit means located in said bi-directional transmission means for carrying out a scattering operation of said reflected wave signal based upon at least one operation coefficient; and (d) signal transmission means, coupled to said junction unit means, said signal transmission means having a multiplier which multiplies a signal inputted thereto by a control coefficient so as to simulate a tone hole; and control means for controlling the delay time, said at least one operational coefficient and said control coefficient in accordance with the pitch of a tone to be synthesized;

wherein a synthesized musical tone signal is output from at least one of said resonance means and said excitation means.

2. A musical tone synthesizing apparatus according to claim 1 wherein said at least one operational coefficient is varied by said control means such that a resonance characteristic of said resonance means is controlled.

3. A musical tone synthesizing apparatus according to claim 1 wherein said excitation means further including non-linear transformation means, by which a non-linear transformation is carried out based on said reflected wave signal and said input signal so that result of said non-linear transformation is output as said excitation signal.

4. A musical tone synthesizing apparatus according to claim 1 further providing attenuating means at a terminal portion of said bi-directional transmission means, said attenuating means attenuating said reflected wave signal based on an attenuation coefficient, wherein said attenuation coefficient is varied by said control means in response to a musical tone to be synthesized.

5. A musical tone synthesizing apparatus according to claim 1 wherein said junction unit means includes at least a first junction unit and a second junction unit, said excitation signal being propagated to said second junction unit via said first junction unit, wherein a first operational coefficient used for said first junction unit is varied by said control means in accordance with a predetermined desired pitch range, and a second operational coefficient used for said scattering operation of said second junction unit is varied by said control means in accordance with a tone pitch within said range of a musical tone to be synthesized.

6. A musical tone synthesizing apparatus according to claim 5 wherein said delay time is varied in a signal path through which said excitation signal is passed to thereby impart a first delay time when feeding back said excitation signal to said excitation means via said first junction unit and a second delay time when feeding back said excitation signal to said excitation means via said second junction, said first and second delay times being varied in response to a tone pitch of a musical tone to be synthesized while keeping a ratio between said first delay time and said second delay time constant.

7. A musical tone synthesizing apparatus according to claim 5 further including attenuating means for attenuating said reflected wave signal which is output from said first junction unit and fed back to said excitation means, wherein an operational coefficient used for said scattering operation of said first junction unit and an attenuation coefficient used for said attenuating means are both varied in response to a predetermined pitch range.

8. A musical tone synthesizing apparatus according to claim 1 wherein said junction unit means includes attenuating means for carrying out an attenuation operation of said progressive wave signal and said reflected wave signal, in which an attenuation coefficient used for said attenuation operation is varied in response to a spectrum of a musical tone to be synthesized.

9. A musical tone synthesizing apparatus according to claim 1 wherein an operational coefficient used for said junction unit means is adjusted in response to an order of resonance frequency of a musical tone to be synthesized.

10. A musical tone synthesizing apparatus according to claim 5 wherein said first and second operational coefficients are both varied in response to an order of resonance frequency of a musical tone to be synthesized.

11. A musical tone synthesizing apparatus according to claim 1 further including delay means in said junction unit means, wherein a delay time of said delay means is adjusted in response to a pitch of a musical tone to be synthesized.

* * * * *